United States Patent [19]

Kageyama et al.

[11] Patent Number: 4,884,910

[45] Date of Patent: Dec. 5, 1989

[54] MECHANICAL PENCIL

[75] Inventors: Hidehei Kageyama; Yoshihide Mitsuya; Yoichi Nakazato, all of Kawagoe, Japan

[73] Assignee: Kotobuki & Co., Ltd., Kyoto, Japan

[21] Appl. No.: 171,881

[22] Filed: Mar. 22, 1988

[30] Foreign Application Priority Data

| | | | |
|---|---|---|---|
| Apr. 17, 1987 | [JP] | Japan | 62-94905 |
| May 2, 1987 | [JP] | Japan | 62-67101 |
| May 2, 1987 | [JP] | Japan | 62-67102 |
| May 2, 1987 | [JP] | Japan | 62-67103 |
| Jun. 23, 1987 | [JP] | Japan | 62-155777 |
| Sep. 25, 1987 | [JP] | Japan | 62-145438 |

[51] Int. Cl.[4] ..... B43K 21/02

[52] U.S. Cl. ..... 401/65; 401/53; 401/55; 401/80; 401/86

[58] Field of Search ..... 401/53, 54, 55, 56, 401/57, 65, 67, 80, 81, 86, 92

[56] References Cited

U.S. PATENT DOCUMENTS

| | | | |
|---|---|---|---|
| 4,478,529 | 10/1984 | Morio | 401/53 |
| 4,504,163 | 3/1985 | Hashimoto et al. | 401/53 |
| 4,650,359 | 3/1987 | Sakaoka | 401/53 |
| 4,714,365 | 12/1987 | Kageyama et al. | 401/65 |

FOREIGN PATENT DOCUMENTS

| | | | |
|---|---|---|---|
| 0215584 | 3/1987 | European Pat. Off. | 401/53 |
| 2153400 | 5/1973 | Fed. Rep. of Germany | 401/81 |
| 3032200 | 3/1982 | Fed. Rep. of Germany | 401/81 |

*Primary Examiner*—Richard J. Apley
*Assistant Examiner*—David J. Bender
*Attorney, Agent, or Firm*—Sherman and Shalloway

[57] ABSTRACT

A mechanical pencil is disclosed in which lead feed occurs automatically upon lifting of the pencil from the paper surface or the like and in which the slider can be locked in a retreated position when the pencil is not in us. The mechanical pencil includes a tip member fitted in the front end of a shell removably, a sleeve disposed slidably in the interior of the tip member, a lead feed mechanism which is mounted in the interior of the sleeve and which permits a forward movement of a lead but inhibits a backward movement of the lead, an ejection bar mounted on the front end side of the sleeve, with the lead extending through the ejection bar, a slider disposed slidably within the tip member and having a locking engaging portion capable of engaging the tip member disengageably, the slider imparting a predetermined frictional force to the lead, and a resilient member disposed between the slider and the ejection bar, the resilient member having an urging force stronger than a lead gripping force of the lead feed mechanism under.

14 Claims, 30 Drawing Sheets

MECHANICAL PENCIL

BACKGROUND OF THE INVENTION

1. Field of the Invention

The present invention relates to a mechanical pencil in which lead feed is done automatically upon release of writing of a slider from the paper surface or the like and the slider can be locked in a retreated position when the pencil is not in use.

2. Description of the Prior Art

Recently there have been proposed automatic mechanical pencils containing a known one-way type chuck unit and capable of effecting rear-end knock, in which a chuck grips lead upon application of writing pressure, while the gripping action of the chuck for the lead is released upon release of the writing pressure, and by a biasing force of a slider acting toward the front end side for writing and by a friction imparting portion inserted in the slider, the lead itself leaves the chuck toward the front end side and is thereby fed for writing.

In all of such proposals, however, the internal structure such as a lead feed mechanism is very complicated, the assembly work efficiency is poor and the number of components is large.

In view of the above problems the applicant in the present case has previously proposed a mechanical pencil in Japanese patent application No. 298641/85 as an original structure of the aforesaid type of mechanical pencils.

According to this proposed mechanical pencil, lead feed can be effected in three ways (automatic writing, front-end knock and rear-end knock) under a relatively simple internal structure. In the lead feed operation by front-end knock, the lead is fed, of course, when it is not projecting from the front end, while when the lead is projecting in excess of a predetermined amount, it is not fed any further, with only cushioning being performed.

However, the foregoing known automatic mechanical pencils and the mechanical pencil of the above prior application are of a structure in which the slider moves alone and the lead is fed out by such movement. Therefore, in carrying the pencil after use, for example when the pencil is put into a pocket, the slider may retreat unnecessarily, allowing only the lead to be fed out inadvertently, thus causing stain of the clothing or breakage of the lead.

In the prior art, moreover, there is a predetermined space between the lead feed mechanism and the slider, with no lead protecting means provided therebetween, so there has been the problem that the lead is broken by some external force and the broken pieces get into the lead feed mechanism and are caught in the lead chuck, causing trouble. Moreover, an extremely complicated internal structure is required for unlocking and locking and stowing the slider, resulting in that the assembling work becomes less efficient and the number of components increases inevitably.

Further, a conventional lead stopper mounted in the interior of the front end side of a mechanical pencil to exert a predetermined frictional force on the lead is constituted by a friction imparting member provided in the interior of a tip member of the mechanical pencil or in the interior of a slider which is slidable axially in the interior of the tip member. The friction imparting member is integrally formed in the shape of a stepped cylinder comprising a cylindrical portion of a large diameter located on the front end side and a cylindrical portion of a large diameter on the rear end side, with a lead insertion hole being formed through the axes of those cylindrical portions.

The friction imparting member is mounted by press-fitting into the tip member or the slider with its small-diameter cylindrical portion facing forward, whereby the entire outer peripheral surface of the friction imparting member is held in frictional engagement with the inner peripheral surface of the tip member or the slider.

In this state, if the lead is inserted into the lead insertion hole of the friction imparting member, a predetermined frictional force is imparted to the lead by the inner peripheral surface of the lead insertion hole. Drop-out of the lead is thereby prevented during writing and the lead is provided with stable support and a smooth lead feed operation.

However, in the conventional lead stopper in an assembled state, the entire outer peripheral surface of the friction imparting member comes into frictional engagement with the inner peripheral surface of the tip member or the slider without leaving any gap, so variations in the radial direction of the friction imparting member and the tip member or the slider as well as variations in the lead diameter cannot be absorbed because it is impossible for the friction imparting member to undergo elastic deformation in a diameter expanding direction.

For example, if the outside diameter of the lead is 0.58 mm, the inside diameter of the lead insertion hole of the friction imparting member is 0.53 mm, the outside diameter of the lead insertion hole is 1.87 mm and the inside diameter of the slider is 1.77 mm, and when the lead is inserted into the lead insertion hole, there occurs in the friction imparting member an expansion of 0.05 mm in relation to the lead diameter and an expansion of 0.07 mm in relation to the slider, that is, an expansion of 0.12 mm in total. But this expansion cannot be absorbed by the friction imparting member which is incapable of undergoing elastic deformation in the diameter expanding direction. Consequently, it becomes no longer possible to impart an appropriate frictional force to the lead and so it becomes impossible to prevent drop-out of the lead and attain stable support and smooth lead feed operation.

Further, since the friction imparting member is formed in the shape of a stepped cylinder and has directionality at the time of mounting, etc., its mounting work is less efficient and the molding die required becomes complicated in structure, thus leading to increase of the cost.

Additionally, the conventional lead chuck is an integral chuck having a slot for opening. But recently there has been developed a lead chuck which per se is divided completely in plural portions.

There has been a lead chuck of such one-way type in which the lead opening operation is performed by pressing the rear end of the lead chuck in a picking form and by the utilization of a lever action using a part of the lead chuck as a fulcrum. However, such a way of lead opening operation causes deviation at the front end of the lead chuck, so when the chuck which is divided in plural portions returns to the lead gripping position, the divided portions shift from each other in the lead gripping position, thus causing slip or breakage of the lead.

SUMMARY OF THE INVENTION

It is the first object of the present invention to provide a mechanical pencil in which its components such as a sleeve, a lead feed mechanism and a coupling, except its shell, are each constructed as a unit-block to thereby simplifying the assembling work and handling and reduce the number of components.

It is the second object of the present invention to provide a mechanical pencil capable of performing three types of lead feed operations.

It is the third object of the present invention to provide a mechanical pencil having a slider lock mechanism of a simple structure to effect locking/stowing and unlocking for a slider easily, thereby preventing the lead from being fed out inadvertently while the pencil is carried, in addition to having the feature of the mechanical pencil of the second object.

It is the fourth object of the present invention to provide a mechanical pencil which is prevented from a sense of incongruity and discomfort caused by retreat of a lead chuck.

It is the fifth object of the present invention to provide a mechanical pencil capable of preventing the breakage of lead and, in the event of accidental breakage of lead, capable of preventing the broken lead from getting into a lead feed mechanism.

It is the sixth object of the present invention to provide a mechanical pencil having a lead stopper capable of undergoing elastic deformation in a diameter expanding direction in an assembled state to thereby permit positive absorption of not only its own variation in the radial direction but also various variations in a tip member or a slider and in the lead diameter, so as to thereby be capable of preventing drop-out of the lead, ensuring stable support and smooth lead feed operation, and permitting easy operation for assembly and molding.

It is the seventh object of the present invention to provide a mechanical pencil capable of effecting front-end knock positively whenever a slide pipe is projecting from a tip member.

It is the eighth object of the present invention to provide a mechanical pencil having a lead chuck capable of preventing the occurrence of inconveniences caused by deviation at the front end portion of the lead chuck, such as slip or breakage of the lead, thereby ensuring a stable opening operation for the lead.

DETAILED DESCRIPTION OF THE PREFERRED EMBODIMENTS

Various embodiments of the present invention will be described hereinunder with reference to the accompanying drawings.

Figure 1:
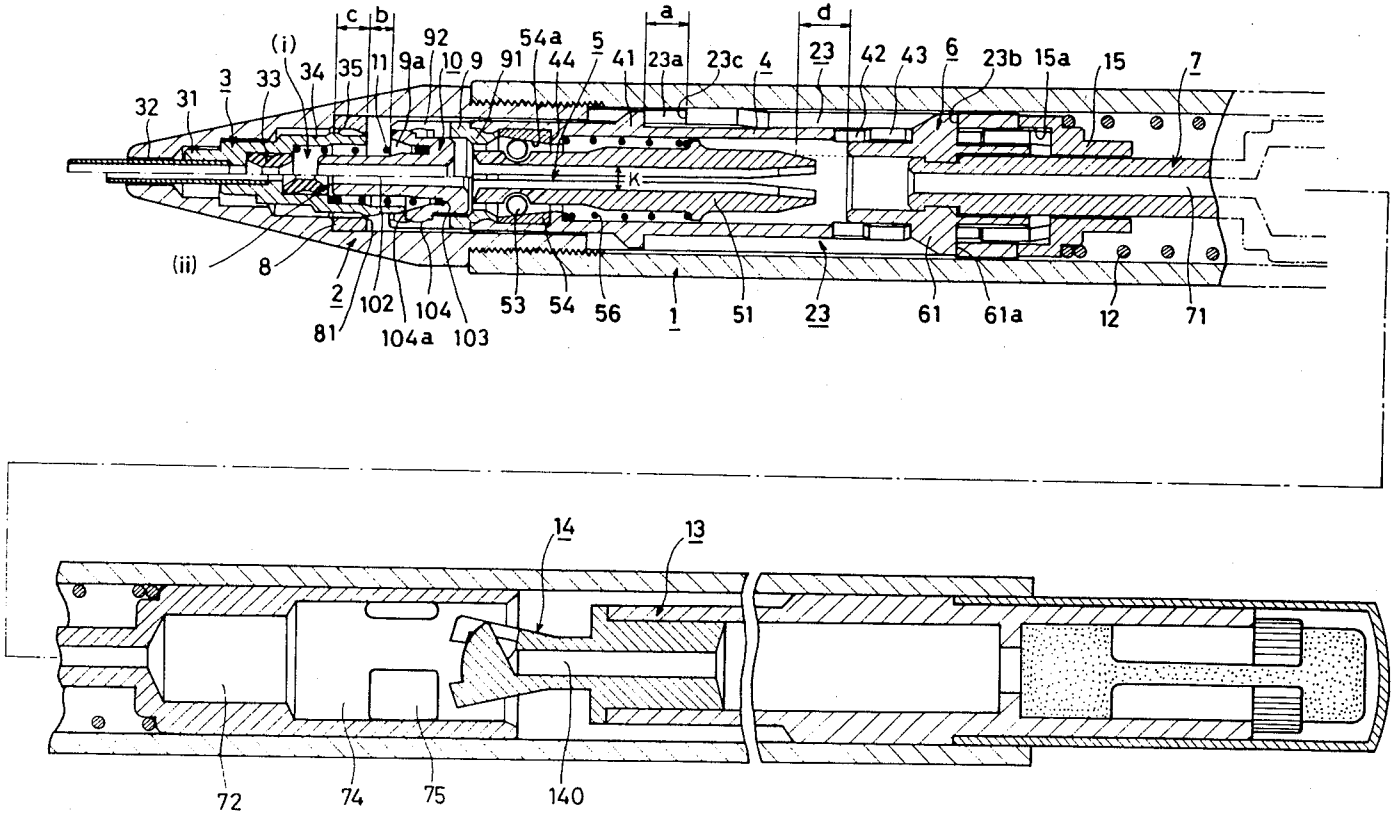
FIG. 1 is a longitudinal sectional view of a first embodiment of the present invention.
Figure 4:
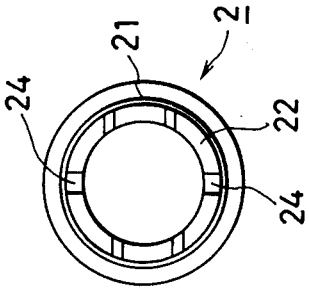
FIG. 4 is a rear view of FIG. 2.
Figure 2:
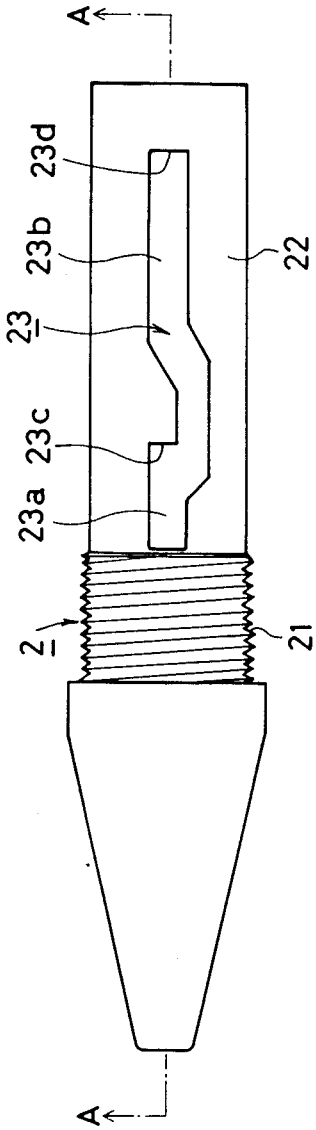
FIG. 2 is a plan view of a tip member.
Figure 3:
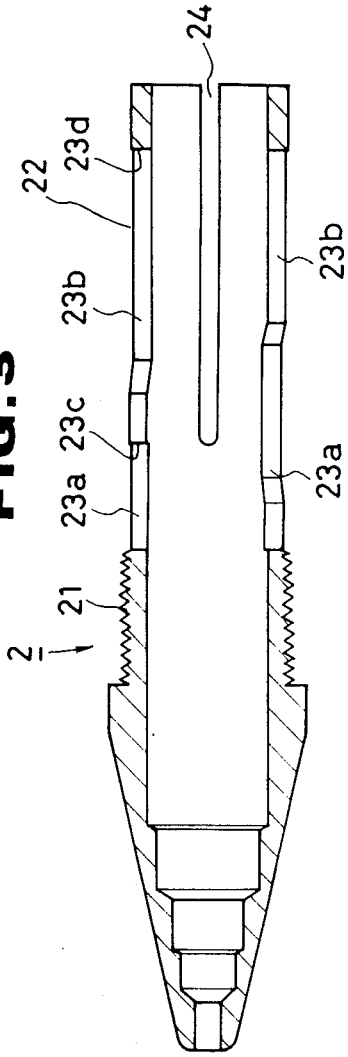
FIG. 3 is a sectional view taken on line A—A of FIG. 2.
Figure 5:
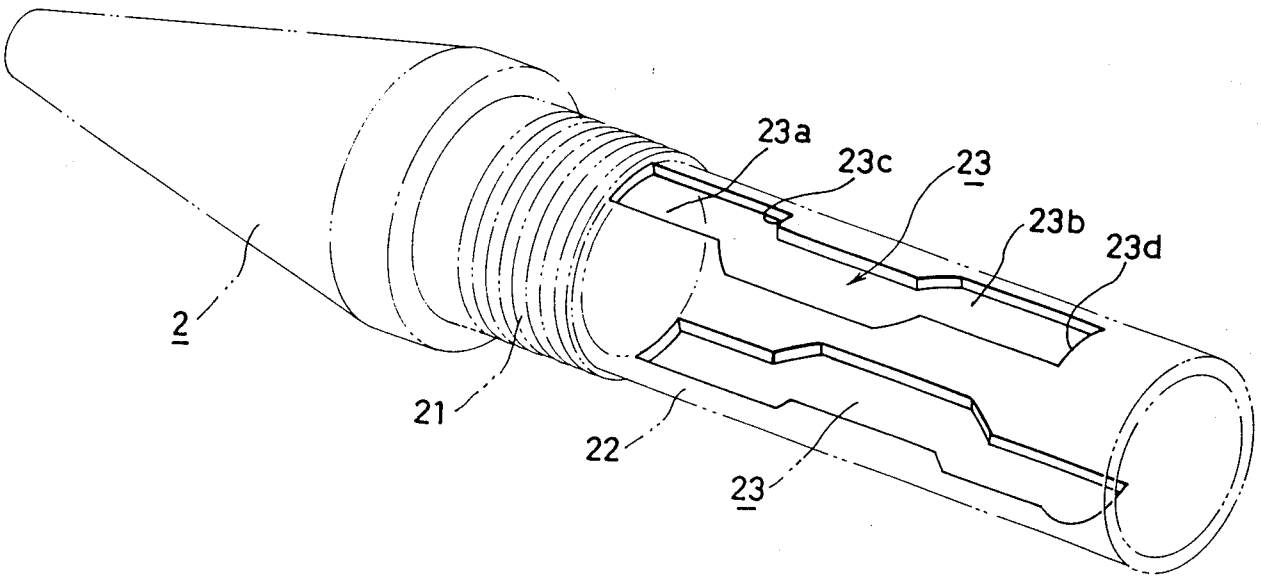
FIG. 5 is an explanatory perspective view of a sliding slot formed in the tip member.

FIG. 1 is a sectional view of a mechanical pencil according to a first embodiment of the present invention. The mechanical pencil has a tip member 2 attached to the front end of a shell 1 removably, a slider 3 received in the tip member 2 axially slidably, a sleeve 4 disposed in the tip member 2 axially slidably, a lead feed mechanism 5 mounted within the sleeve 4, a stopper 6 which is axially slidable through the interior of the rear portion of the sleeve 4, and a coupling 7 fitted and connected into the stopper 6.

The tip member 2, as shown in FIGS. 1 to 3 and 5, has a fitting portion 21 for the shell 1 and a rear cylindrical portion 22 contiguous to the rear end of the fitting portion 21. The rear cylindrical portion, as shown in FIGS. 1 to 5, is formed with a pair of sliding slots 23 of a symmetric shape and slits 24 for ensuring radial elastic deformation of the rear cylindrical portion 22.

The paired sliding slots 23, as shown in FIGS. 1 to 5, are formed in an axially symmetric crank shape and each provided with a sleeve projection sliding slot 23*a*, for sliding therethrough of a later-described sleeve projection (sleeve engaging portion) 41, a stopper projection sliding slot 23*b* for sliding therethrough of a stopper projection 61, and a sleeve retreat restricting stepped portion 23*c* formed at the rear end of the sleeve projection sliding slot 23*a*. The sleeve retreat restricting stepped portion 23*c* functions to restrict a backward movement of the sleeve projection 41 moving backward in response to front-end knock or excess writing pressure damping action.

In an external force-free state (see FIG. 1) there is a distance a between the sleeve retreat restricting stepped portion 23*c* and the rear end of the sleeve projection 41.

A stopper lug retaining wall portion 23*d* formed at the rear end of the stopper projection sliding slot 23*b* functions to engage the stopper projection 61 and obtain a single unit-block of the tip member 2, sleeve 4 and coupling 7 which are each constructed as a block.

On the other hand, as shown in FIG. 1, an annular slider receiving portion 8 is fitted in the front-side inner wall of the tip member 2, and inside the rear end of the slider receptable portion 8 there inwardly projects an annular slider stopper 81 which engages the slider 3 disengageably.

The slider 3, as shown in FIGS. 1 and 6 to 8, has a slider body 31, a slide pipe 32 fitted in the front end side of the slider body 31, and a symmetric, directionality-free, friction imparting member 33 fitted in the interior of the slider body 31 to impart a predetermined frictional force (e.g. 13–20*g*) to a lead S. The rear side of the slider body 31 is formed with a plurality (four in this embodiment) of divided engaging pieces 34 which are engageable with the slider stopper 81 and capable of expanding and contracting in the diametrical direction. The engaging pieces 34 are each provided with an outwardly projecting engaging protuberance for engagement with and disengagement from the slider stopper 81.

Figure 8:
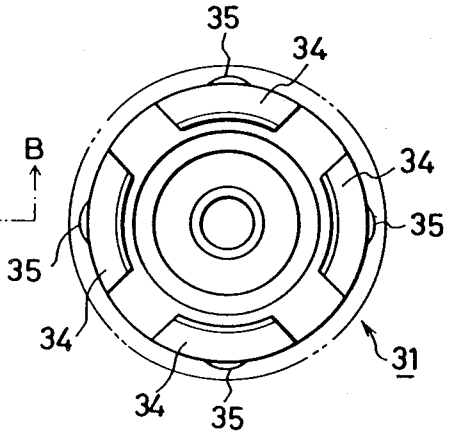
FIG. 8 is a rear view of FIG. 6.
Figure 6:
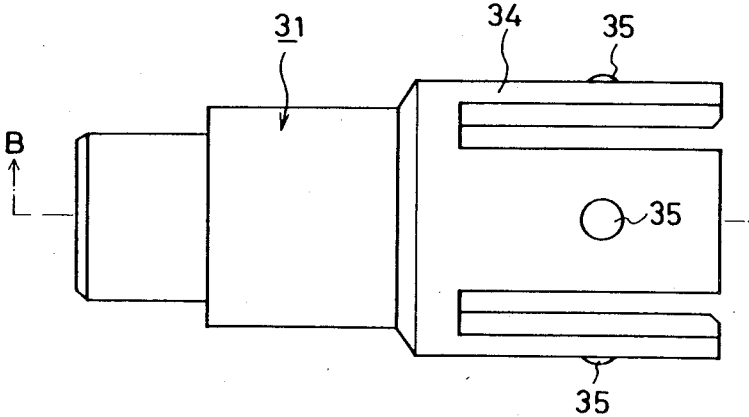
FIG. 6 is a plan view of a slider.
Figure 7:
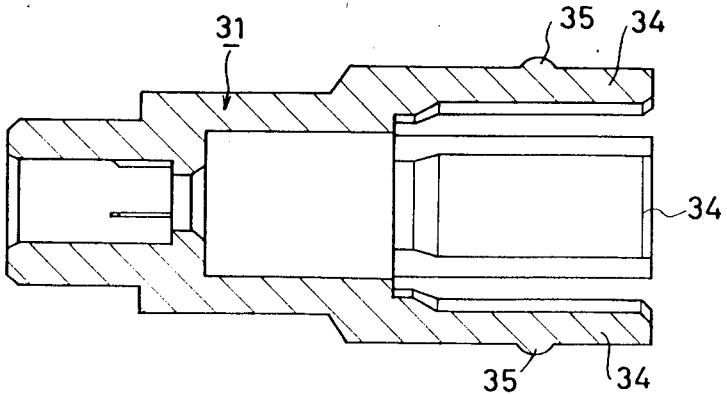
FIG. 7 is a sectional view taken on line B—B of FIG. 6.
Figure 11:
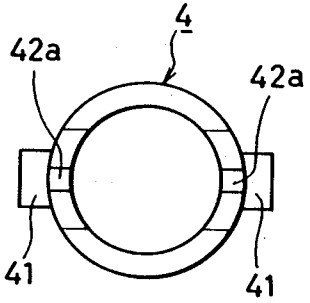
FIG. 11 is a rear view of FIG. 9.

Of the two pairs of opposed engaging protuberances 35 shown in FIGS. 6 to 8, any one pair may be omitted.

The upper half portion of the slider 3 and of a later-described ejection bar 10 in FIG. 1 [indicated at (i) in FIG. 1] shows a condition in the absence of any special external force such as when the pencil is not in use (hereinafter referred to as the "normal" condition), while the lower half portion [indicated at (ii) in FIG. 1] shows a later-described locked state.

Figure 9:
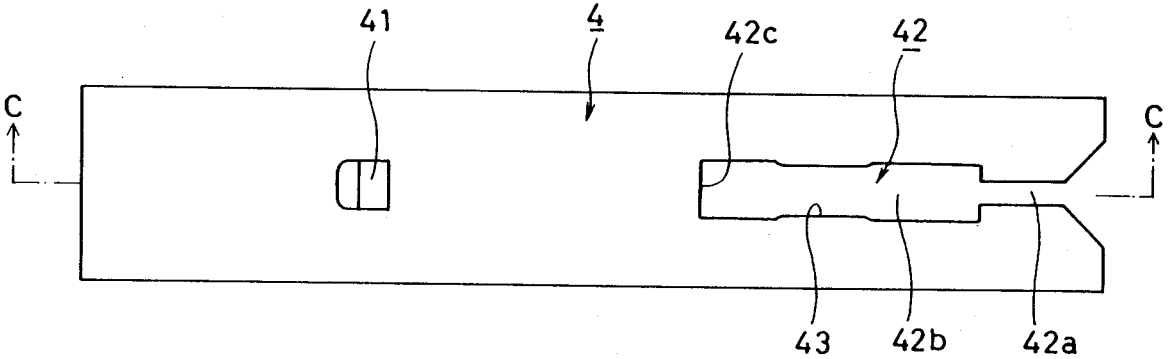
FIG. 9 is a plan view of a sleeve.
Figure 10:
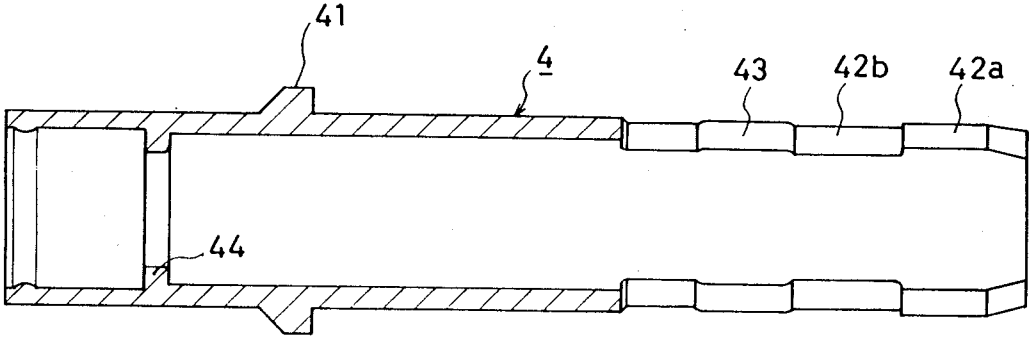
FIG. 10 is a sectional view taken on line C—C of FIG. 9.

The sleeve 4 is disposed axially slidably within the tip member 2. As shown in FIGS. 1, 9 and 10, the sleeve 4 is cylindrical and the outer periphery of its front side is formed with a pair of sleeve projections 41 for sliding through the sleeve projection sliding slot 23*a*, while on the rear side there are formed a pair of sliding slots 42 of the same shape which permits sliding therethrough of the stopper projections 61

Each sliding slot 42, as shown in FIGS. 9 and 10, has a guide slot 42*a* for guiding the stopper projection 61, and a frictional sliding slot 42*b* which is in communication with the guide slot 42*a*, with a frictional stepped portion 43 being formed intermediately of the frictional sliding slot 42*b*. As will be explained later, the frictional stepped portion 43 functions to impart a frictional force to the stopper projection 61 and let the entire sleeve 4 advance a predetermined distance together with the stopper 6 to feed the lead S.

As shown in FIG. 1, the ejection bar 10 is connected to the front end of the sleeve 4 through a drum ring 9; the lead feed mechanism 5 is disposed in the interior of the sleeve; and at the rear end portion of the sleeve 4, the coupling 7 is engaged therewith and the axially slidable stopper 6 is disposed.

Figure 12:
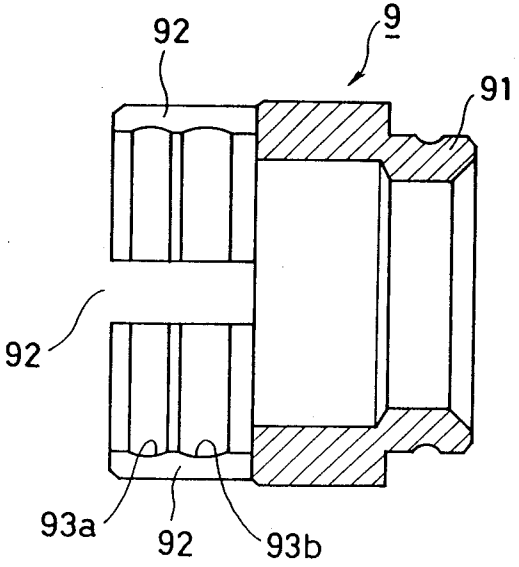
FIG. 12 is a central longitudinal sectional view of a drum ring.

The drum ring 9, which is fitted in the front end of the sleeve 4, (1) fulfills a guide function of internally holding the ejection bar 10 movably (slidably) in a predetermined range, (2) also functions to prevent drop-out of later-described balls 53 at a rear stepped portion 91. On the front end side of the drum ring 9, as shown in FIGS. 1 and 12, there are formed one or more (four in this embodiment) axially extending slits 92 to ensure the stowing of the ejection bar 10. The reference numerals 93*a* and 93*b* shown on the front end side of the drum ring 9 each represent a retaining concave portion formed to retain a convex portion 104 of the ejection bar 10 movably with a predetermined engaging force as will be described later. The retaining concave portions 93*a* and 93*b* retain the ejection bar in the advanced position and retreated position, respectively.

Figure 13:
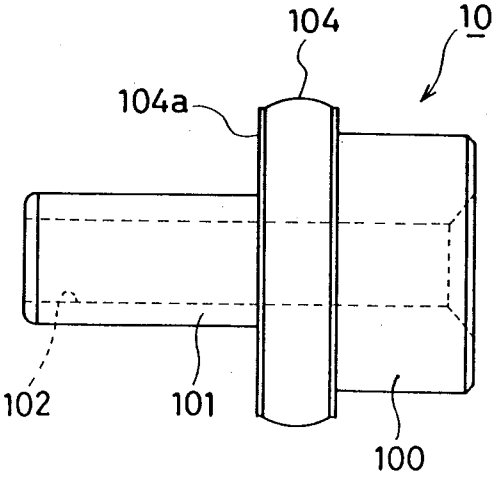
FIG. 13 is a plan view of an ejection lever.
Figure 14:
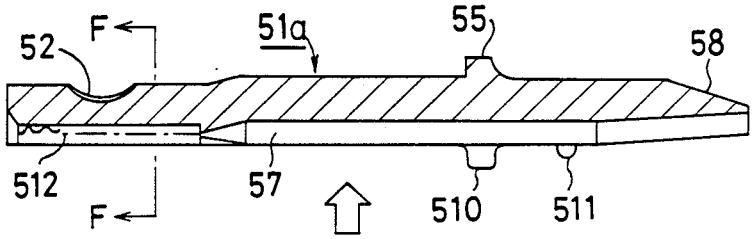
FIG. 14 is a longitudinal sectional view of a lead chuck.
Figure 15:
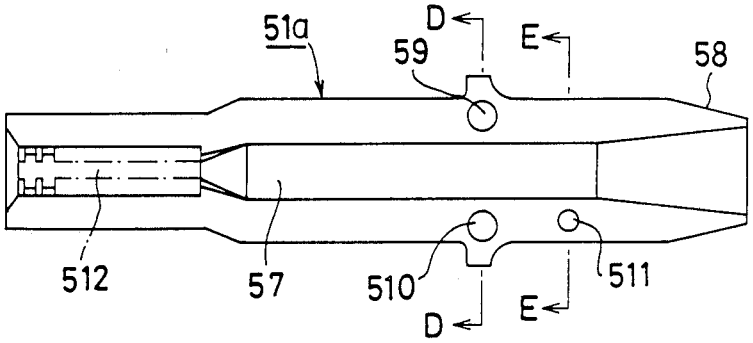
FIG. 15 is a view as seen in the arrowed direction in FIG. 14.
Figure 16:
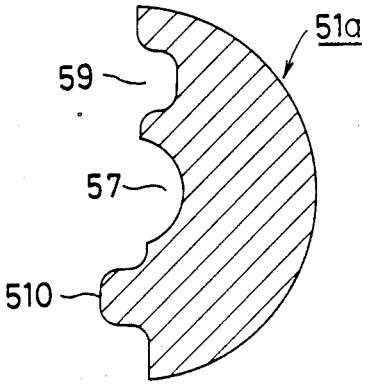
FIG. 16 is a sectional view taken on line D—D of FIG. 15.
Figure 17:
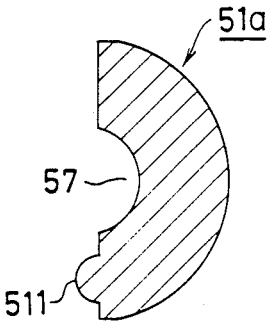
FIG. 17 is a sectional view taken on line E—E of FIG. 15.

The ejection bar 10 held by the drum ring 9, as shown in FIGS. 1 and 13, has a bar body 100, an axially extending cylindrical portion 101 centrally located in the interior of the bar body 100, a lead insertion hole 102 formed in the interior of the cylindrical portion 101, a retaining portion 103 for retaining the rear end of a later-described first resilient member 11, and the convex portion 104 which movably engages the retaining concave portions 93*a* and 93*b* of the drum ring 9.

The engaging force between the retaining concave portion 93*a* on the front side (advanced position) of the drum ring 9 and the convex portion 104 is set at a value (e.g 300 g+50 g) larger than the engaging force (e.g. 100 g+30 g) between the engaging protuberances 35 of the slider 3 and the slider stopper 81. This is because at the time of front-end knock the slider stopper 81 and the slider 3 are unlocked by abutment of a front end 104*a* of the convex portion of the ejection bar 10 with the rear end of the slider 3, as will be described in more detail later.

In the normal condition, as shown in FIG. 1, (a) there is a distance b between the rear end of the slider 3 as well as the rear end of the slider receiving portion 8 and the front end 104*a* of the convex portion of the ejection bar. 10. The distance b, as will be described later, (1) corresponds to a lead feed quantity in rear-end knock and front-end knock and (2) it represents an automatic writing capability range. (b) There is a distance c as a retreat distance for engagement of the engaging protuberances 35 of the slider 3 with the slider stopper 81.

Further, the first resilient member 11 (having a biasing force of say 10–12 g) is provided between the ejection lever 10 and the slider 3. It urges the slider 3 forward in the interior of the slider and outside the cylindrical portion 101 of the ejection bar 10, and at the same time it urges backward the ejection bar 10 and the sleeve 4 located therebehind.

The cylindrical portion 101 of the ejection bar 10 extends long in the axial direction to cover the lead S in as large an area as possible, thereby preventing the breakage of the lead and also preventing the entry of lead waste or broken lead into a lead chuck 51. It further functions to retain the rear end of the lead feed mechanism 5 disposed within the sleeve 4.

The lead feed mechanism 5 has a bisplit lead chuck 51, balls 53 held by a ball holding portion 52 at the head of the lead chuck 51, a metallic cylinder 54 adapted to be fitted as necessary into the front end portion of the sleeve 4 and having a tapered inner wall 54*a* for holding the balls 53 between it and the ball holding portion 52, and a second resilient member 56 for clamping the chuck, the second resilient member 56 being disposed between a stepped inner wall portion 44 of the sleeve 4 and a stepped retaining portion 55 of the lead chuck 51.

The lead chuck 51 is formed of a forged or pressed sintered alloy, a molded metal obtained by die casting, or a synthetic resin molding obtained by compression molding.

In this embodiment, as shown in FIGS. 1 and 14 to 17, the lead chuck 51 is divided in two along the axis of a lead insertion hole 57 and comprises a pair of chuck members 51*a* and 51*b* each having a hemispherical section. And it has the ball holding portion 52, the stepped retaining portion 55 provided at the rear portion, a cylindrical rear tapered portion 58 extending backward from the rear end of the stepped retaining portion 55 so that it is smaller in diameter on the rear end side, the lad insertion hole extending along the axis, an engaging concave portion 59, an engaging convex portion 510, and an open/close fulcrum protuberance 511.

The engaging concave and convex portions 59 and 510 are provided so that the engaging convex portion 510 of one chuck member 51*a* may be engaged with the engaging concave portion 59 of the other chuck member 51*b* and the engaging convex portion 510 of the other chuck member 51*b* may be engaged with the engaging concave portion 59 of one chuck member 51*a*, whereby the chuck members 51*a* and 51*b* are prevented from axial deviation from each.

The engaging concave and convex portions 59 and 510 function as a fulcrum to bring the open/close fulcrum protuberances 511 of the chuck members 51*a* and 51*b* into abutment with each other and let the chuck members perform a lever motion in the opening and closing directions, and also function as a spacer for forming a sufficient gap K (see FIG. 1) to ensure a smooth lever motion.

If the length of each engaging concave portion 510 in the radial direction of the lead insertion hole 57 is made larger by a distance corresponding to the distance of the open/close fulcrum protuberance 511, it is possible to omit the open/close fulcrum protuberances 511. Even in this case it is possible to attain the spacer function to form the gap K.

Further, on the front end side of the lead insertion hole 57 in the inner wall of the head portion of the lead chuck 51 there are provided lead holding holes 512 in a stepped shape of a smaller diameter.

The lead holding holes 512 are semisplit holes formed centrally along the inner peripheral surfaces of the semisplit lead insertion holes 57 in the chuck members 51*a* and 51*b*. Their sectional shape is, for example, as shown in FIGS. 17 to 20.

Figure 18:
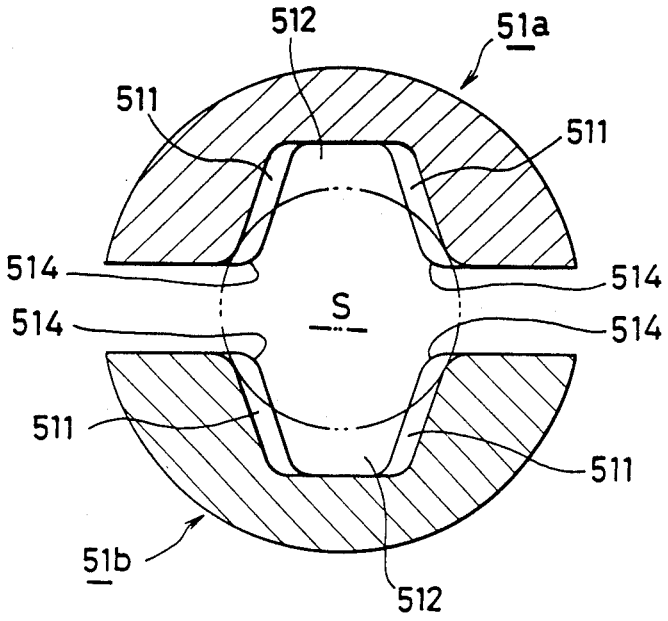
FIG. 18 is a sectional view taken on line F—F of FIG. 14.
Figure 19:
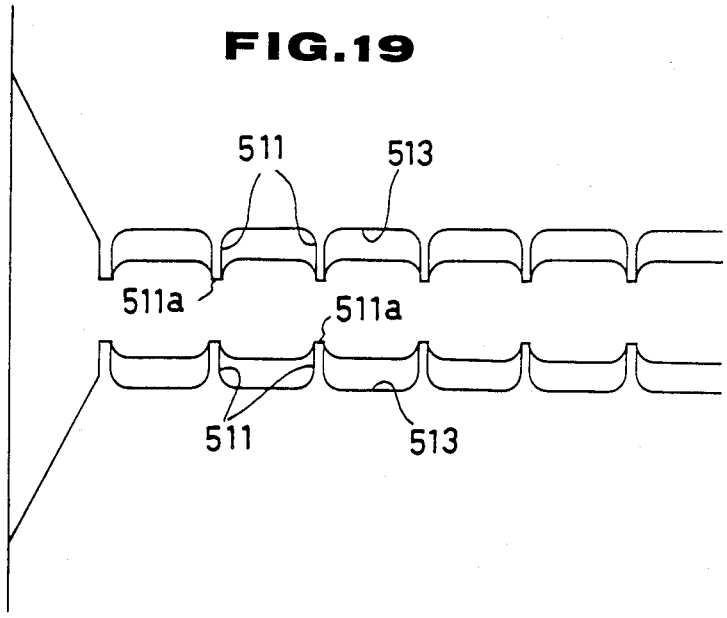
FIG. 19 is an enlarged plan view of a tooth portion.
Figure 20:
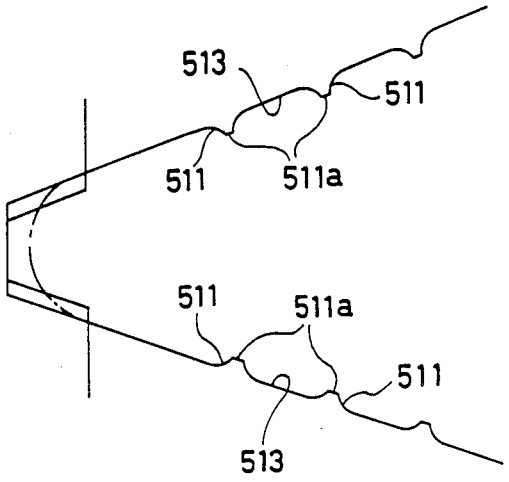
FIGS. 20 and 21 are enlarged explanatory views of the tooth portion.
Figure 21:
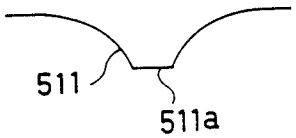

More specifically, the lead holding holes 512 are each formed in generally U shape in section larger in width on the chuck side for the lead S. On the inner surfaces of both sides of each lead holding hole 512 there are formed a plurality of tooth portions 511 at predetermined intervals in their width direction. The tooth portions 511, as shown in FIGS. 18 to 20, are in a tapered form which is sharper on the front end side. Respective front end faces 511*a* are narrow flat faces and respective root portions 513 are also flat. Further, the tooth portions 511 form lead support portions 514 which support the outer periphery of the lead S at four points in an integrally assembled state of the chuck members 51*a* and 51*b*.

The lead support portions 514 formed by the tooth portions 511 afford a sufficient lead gripping force to hold the lead to an appropriate extent. Besides, the construction adopted permits the escape of dust, wastes and the like, e.g. lead wastes, so there is no fear of lead wastes being accumulated throughout the pencil. Even if lead wastes or the like begin to accumulate, they will be removed naturally with movement of the lead such as lead feed motion.

Consequently, there is attained an outstanding effect that there will be no lead slip even in frequent writing over a long period.

Figure 22:
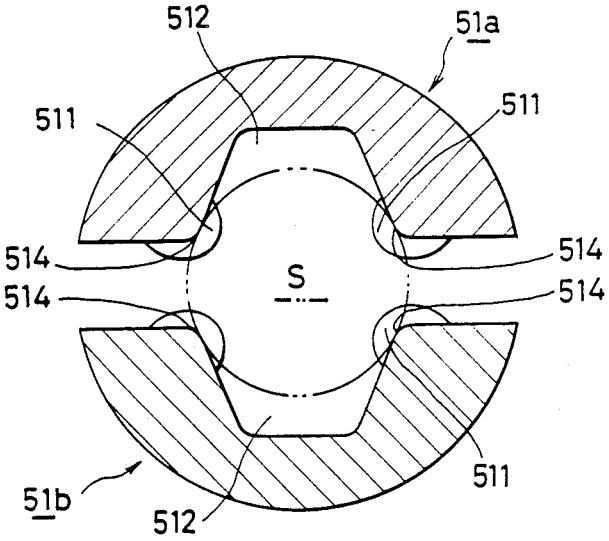
FIGS. 22 to 24 are longitudinal sectional views showing other examples of lead chuck head portions.
Figure 23:
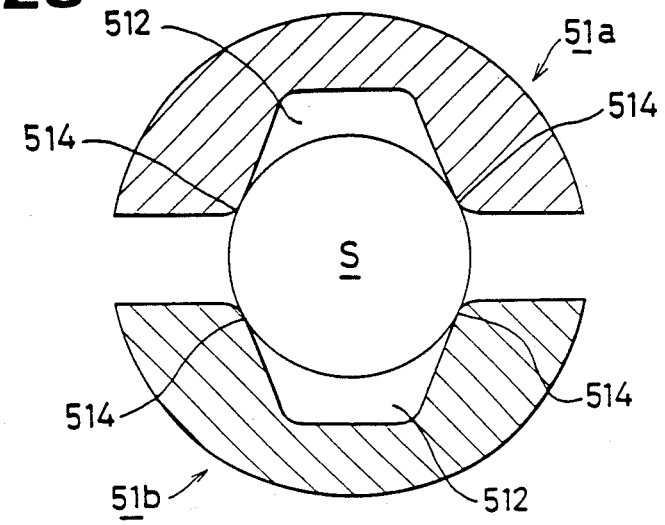
Figure 24:
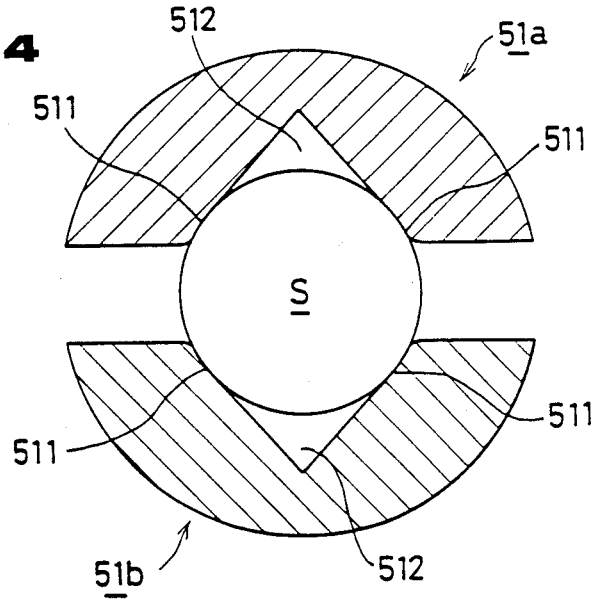

Referring now to FIGS. 22 to 24, there are illustrated other examples of the chuck members 51*a* and 51*b*.

In the example of FIG. 22, tooth portions are formed projectingly only in the vicinity of the lead support portions 514.

In the example of FIG. 23, the tooth portions 511 of the lead holding holes 512 in the above example are removed and both ends of the open ends of the lead holding holes 512 serve as lead support portions 514.

In the example of FIG. 24, the lead holding holes 512 in FIG. 22 are formed in V shape in section.

Therefore, also in the led holding holes 512 shown in FIGS. 22 to 24 there is attained about the same effect as in FIGS. 18 to 21.

The lead holding holes 512 of the above examples may have other sectional shapes if only they can support the lead S at four points as described above.

On the other hand, the balls 53 held by the head portion of the lead chuck 51, as shown in FIG. 1, are fitted in and held between the chuck head and the tapered inner wall 54*a* of the metallic cylinder 54 provided at the front end portion of the sleeve 4.

The metallic cylinder 54 ensures positive, durable and stable rolling contact and positive lead holding performed by the lead chuck 51, and enhances durability.

The metallic cylinder 54 is not always necessary. In normal use of the mechanical pencil, the metallic cylinder 54 may be omitted if the tapered inner wall 54*a*is formed at the inner surface of the front end of the sleeve 4 in the form of rolling contact with the balls 53.

Although the lead chuck 51 illustrated is a bisplit chuck, it may be divided in three or more segments, or may be even a single body. To prevent axial deviation, etc. of the lead chuck 51, the contact portion of the chuck members may be formed with engaging convex and concave or deviation preventing notches. A part of the diameter of the lead chuck 51 closely resembles the inside diameter of the sleeve 4, and the rear end of the second resilient member 56 is positively retained by the stepped retaining portion 55 of the lead chuck 51, so vertical and transverse fluttering motions and deviations of the lead chuck 51 are sure to be prevented. The ball holding portion 52 of the lead chuck 51 may be a mere hole for holding the balls 53, or it may receive the balls 53 therein to prevent drop-out of the balls. The balls 53 is rotatable in the ball holding portion 52.

The second resilient member 56 has a biasing force weaker than that of the first resilient member 11.

The stopper 6 provided on the rear end side of the sleeve 4 has a pair of upper and lower projections 61 as shown in FIG. 1 and it is fitted on the front end of the coupling 7 as previously noted. The stopper projections 61 fulfill the following functions. (1) It is retained in abutment with the stopper projection retaining wall **23*d* of the tip member 2 by a backward urging force of a third resilient member 12 to combine the tip member 2, the sleeve 4 and the coupling 7 which are constructed each in the form of a block, into one unit-block. (2) At the time of rear end knock, it comes into sliding engagement with the frictional sliding slots 42*b* and frictional stepped portions 43 of the sleeve 4 and moves the sleeve 4 forward by only a predetermined distance. (3) Subsequent advance causes forward movement of only the stopper 6, coupling 7 and lead pipe 13 until abutment with the rear end portion of the lead chuck 51, thereby pressing the chuck rear end to open the lead chuck 51**.

In the above normal operation, as shown in FIG. 1, there is a distance d between the front end of the stopper 6 and the abutting part of the lead chuck 51.

The coupling 7 inserted in and engaged with the stopper 6 fulfills not only the function as a lead guide but also the function of connecting the lead pipe 13 removably. It has a lead feed hole 71 having an inside diameter which permits only one lead S to pass therethrough, a chuck receiving hole 72 formed contiguously to the rear end of the lead feed hole 71 and into which is removably inserted a chuck opening/closing mechanism 14 fitted in the front end of the lead pipe 13 in this embodiment, a stepped fitting hole 74 of a large diameter contiguous to the rear end of the chuck receiving hole 72 and into which is inserted the front end side of the lead pipe 13 removably, and an engaging projection 75 projecting from the inner wall of the fitting hole 74 to ensure the connection of the lead pipe 13.

The front end of the lead pipe 13 is provided with the chuck opening/closing mechanism 14 as noted above. The chuck opening/closing mechanism 14 is described in detail in Japanese patent application No. 204692/86 the pertinent part of which is set forth below as translated into the English language.

In a lead cartridge opening and closing unit, outward engaging piece portions are provided on a chuck type opening and closing mechanism which is divided into sections in the diametrical direction and has inward elastic force and which is further disposed on the lead cartridge; the outward engaging piece portions moving inwardly against the inward elastic force along the diametrical direction thereof thereby to open lead conducting holes in case of forcible insertion into and engagement with a lead guide, whilst the outward engaging piece portions being restored by means of the inward elastic force to move outwardly along the diametrical direction thereof thereby to close the lead conducting holes in case of release for the forcible insertion and engagement. (Operation)

When the outward engaging piece portions of the chuck type opening and closing mechanism are forcibly fitted in the lead guide, the outward engaging piece portions move inwardly along the diametrical direction thereof to be resiliently fitted to and engaged with the lead guide so that the lead conducting holes are opened, and on the other hand when the outward engaging piece portions are drawn out from the lead guide, these outward engaging piece portions are restored outwardly by means of the inward elastic force along the diametrical direction thereof so that the lead conducting holes are closed.

Of course, the lead conducting hole opens even before the mechanism is forcedly inserted and engaged with the lead guide in case that the lead is held by the lead chuck and extruded from the lead guide.

Between the coupling 7 and the tip member 2 is disposed the third resilient member 12 through a resilient member receiving portion 15. The third resilient member 12 fulfills (1) a forward returning function for the sleeve 4, the lead feed mechanism 5 and the ejection bar 10 at the time of front-end knock, (2) a backward returning function for the coupling 7 and the lead pipe 13 at the time of rear-end knock, and (3) an excess writing pressure damping function in writing. And it has a relatively strong biasing force (e.g. 370–400 g).

The resilient member receiving portion 15 which receives the front end side of the third resilient member 12 comes into abutment on the front end side thereof with the rear end of the tip member 2 and that of the sleeve 4, whereby it is made possible for one third resilient member 12 to fulfill the above three functions.

In the abutment with the rear end of the sleeve 4 an inner wall hole **15*a* of the resilient member receiving portion 15 grippingly presses the rear end of the sleeve 4 as shown in FIG. 1, so that the sleeve rear end is reduced in diameter. Thus, the rear end of the sleeve 4 having slits 24** is made extremely strong.

An urging force A of the first resilient member 11, a frictional force B of the friction imparting member 33 to the lead S, an engaging force C between the concave portion **93*a* of the drum ring 9 and the convex portion 104 of the ejection lever 10, an engaging force D between the slider 3 and the slider stopper 81, and a gripping force E of the lead chuck 51** for the lead S, are in the following relations:

(1) $B>A$ If this relation is not satisfied in a later-described front-end knock, there will occur lead slip between the friction imparting member 33 and the lead S.

(2) $C>D$ This is because, as previously noted, the slider 3 engaged with the slider stopper 81 is unlocked by pressing of the front end of the ejection bar 10.

(3) $A>E$ This is because at the time of performing a later-described front-end knock and so-called automatic writing it is necessary that the lead S be drawn out forward from the chuck 51 by advance of the slider 3.

The foregoing distances a to d are in the relation of $d>a>c>b$.

The following is an explanation about assembling of the mechanical pencil of the invention.

First, the lead feed mechanism 5 is mounted into the sleeve 4. More particularly, the chuck members **51*a* and 51*b* are assembled together and the second resilient member 56 is loosely fitted over the outer periphery of the assembled chuck. On the other hand, the metallic cylinder 54 is press-fitted beforehand along the inner wall of the front end portion of the sleeve 4. Then, the chuck members 51***a* and 51*b* with the second resilient member 56 loosely fitted thereon are inserted from the rear into the sleeve 4. Next, the chuck members 51*a* and 51*b* are pressed from the rear to compress the second resilient member 56 and the balls 53 are inserted in the ball holding portion 52 of the chuck members 51*a* and 52*b*, followed by release of the pressure, whereby the balls 53 are sure to be set in the ball holding portion 52. Thereafter, the drum ring 9 is press-fitted into the front end of the sleeve 4. In this case, the ejection bar 10 with the first resilient member 11 engaged therewith is received beforehand into the drum ring 9.

By such a series of assembling operations, the sleeve 4, the lead feed mechanism 5, the drum ring 9, the ejection bar 10 and the first resilient member 11 are assembled as a block.

On the other hand, the slider receiving portion 8 and the slider 3 are mounted and set beforehand into the tip member 2 to obtain a block of the tip member.

Further, the third resilient member 12 and the resilient member 15 are set to the coupling 7 and lastly the stopper 6 is brought into engagement with the same coupling to obtain a block. Urging force is exerted on the stopper 6 by virtue of the third resilient member 12 through the coupling fitted in the stopper and also through the resilient member receiving portion 15.

Explanation will now be made about the operation for arranging the components except the shell 1, namely, the tip member 2, the sleeve 4 and the coupling 7 each available now as a block, into a unit. In this unitizing operation, first the sleeve 4 as a block is inserted from the rear end of the tip member 2 now also available as a block. As a result, the projections 41 of the sleeve 4 are brought into engagement with the sleeve projection sliding slots 23*a* of the tip member 2 as shown in FIG. 1, and the paired sliding slots 23 of the tip member 2 and the paired sliding slots 42 of the sleeve 4 are located in constant positions.

Then, the coupling 7 now available as a block is inserted from the rear end of the tip member 2 and that of the sleeve 4. This insertion is performed so that the stopper projections 61 of the stopper 6 on the front end side of the coupling 7 come into engagement with the interior of the sliding slots 23 of the tip member 2 and that of the sliding slots 42 of the sleeve 4.

Since the stopper 3 is urged by the third resilient member 12 as noted above, rear wall portions 61*a* of the stopper projections 61 are pressed and retained by the stopper projection retaining walls 23*d* of the sliding slots 23 of the tip member 2, as shown in FIG. 1, whereby the tip member 2, the sleeve 4 and the coupling 7 now each available as a block are unitized and can be handled as a single unit block.

Lastly, this unit block is inserted from the front end of the shell 1 and the lead pipe 13 inserted into the coupling 7 from the rear end of the shell. Now the assembly of the mechanical pencil is over.

The following is an explanation about the lead feed operation in the present invention.

The lead feed operation can be performed by the following three methods.

(1) As the first means, which is normal means, the feed of lead is effected by knocking the rear end of the lead pipe 13.

More specifically, when the rear end of the lead pipe 13 is knocked in the state of FIG. 1, the coupling 7 moves forward while compressing the third resilient member 12. In this case, since the stopper 6 at the front end of the coupling 7 is retained by the frictional force of the frictional stepped portions 43 of the frictional sliding slots 42*b* of the sleeve 4, the whole of the sleeve 4 now available as a block, namely, the sleeve 4, lead feed mechanism 5, drum ring 9 and ejection bar 10, move forward together with the coupling 7 until when the front end of the drum ring 9 abuts the rear end of the slider receiving portion 8. These components together advance the distance b between the front end of the drum ring 9 and the slider receiving portion 8. The distance b corresponds to the lead feed quantity. The lead pipe 13, the coupling 7 and the stopper 6 are further pressed forward and the stopper projections 61 get over the frictional stepped portions 43 of the sleeve 4. Only the stopper 6, coupling 7 and lead pipe 13 advance. Then, the front end of the stopper 6 urges the rear end portion of the lead chuck 51 forward to release the holding of the lead S. The normal feed of the lead is performed by repeating the above operations.

(2) As the second means, writing is discontinued to thereby permit an automatic lead feed operation.

Figure 25:
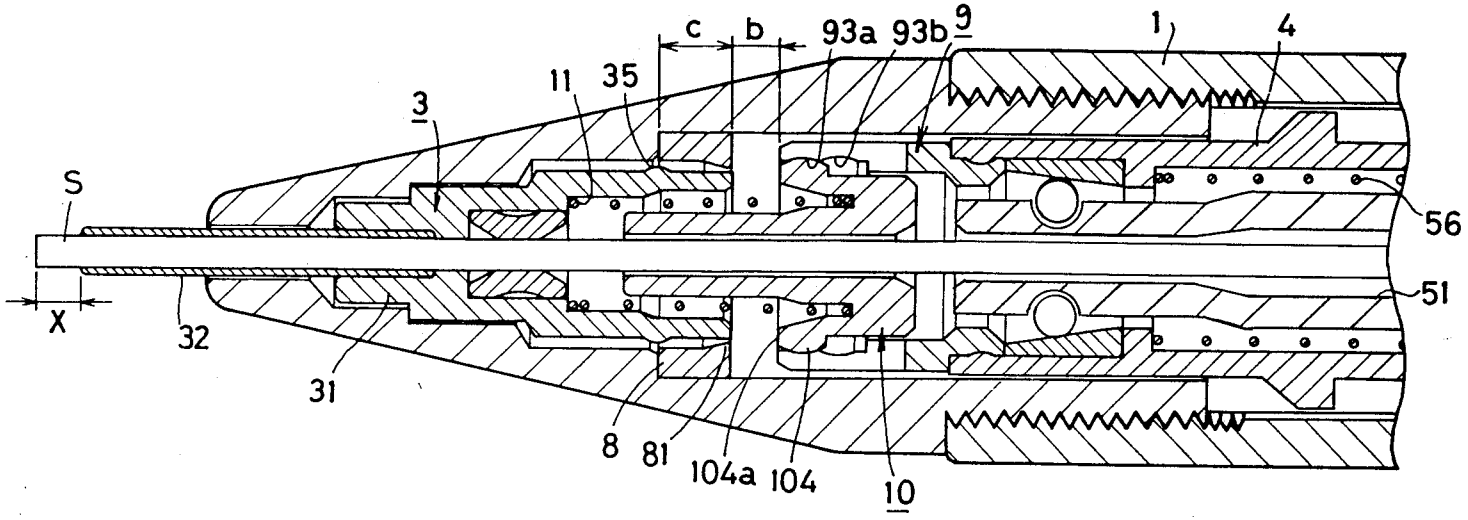
FIGS. 25 to 29 are explanatory views of lead feed operation and locking operation.
Figure 26:
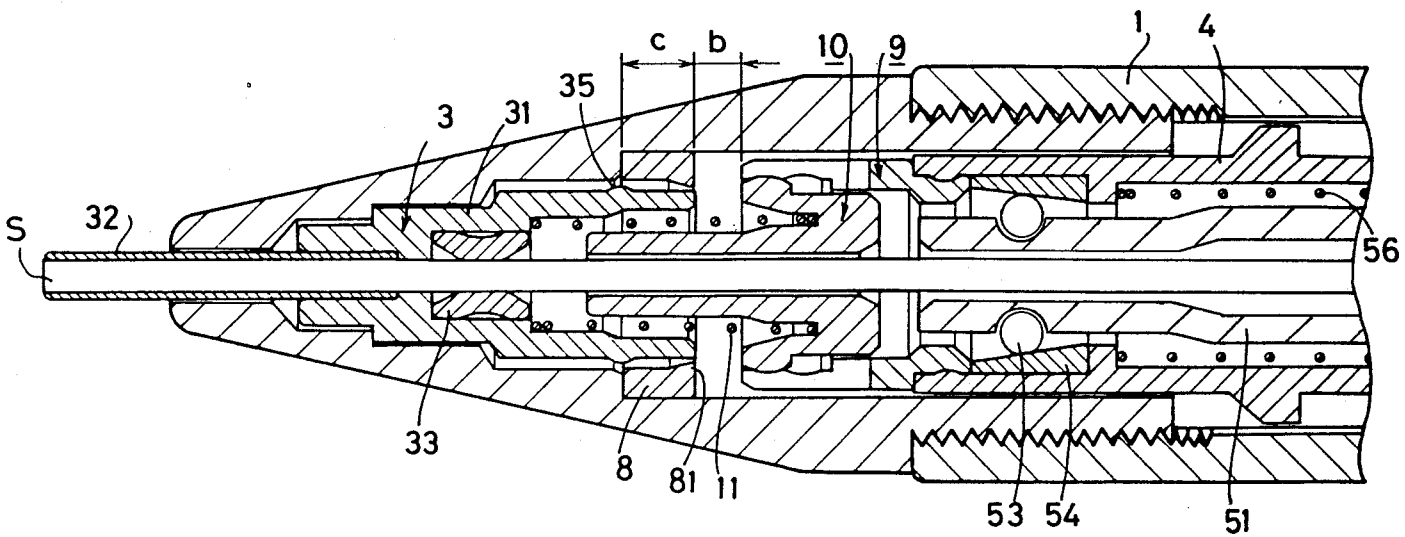

More specifically, writing is normally performed in a projecting state of the lead S by a predetermined distance X from the slide pipe 32 as shown in FIG. 25. With writing, the lead S wears gradually and becomes flush with the front end of the slide pipe 32 as shown in FIG. 26. Even in this state the slider 3 can move back against the urging force of the first resilient member 11; further, it can retreat the greatest distance, namely, the distance to the abutment with the front end 104*a* of the convex portion of the ejection bar 10, which distance corresponds to the retreat distance b shown in FIGS. 1 and 26.

Figure 27:
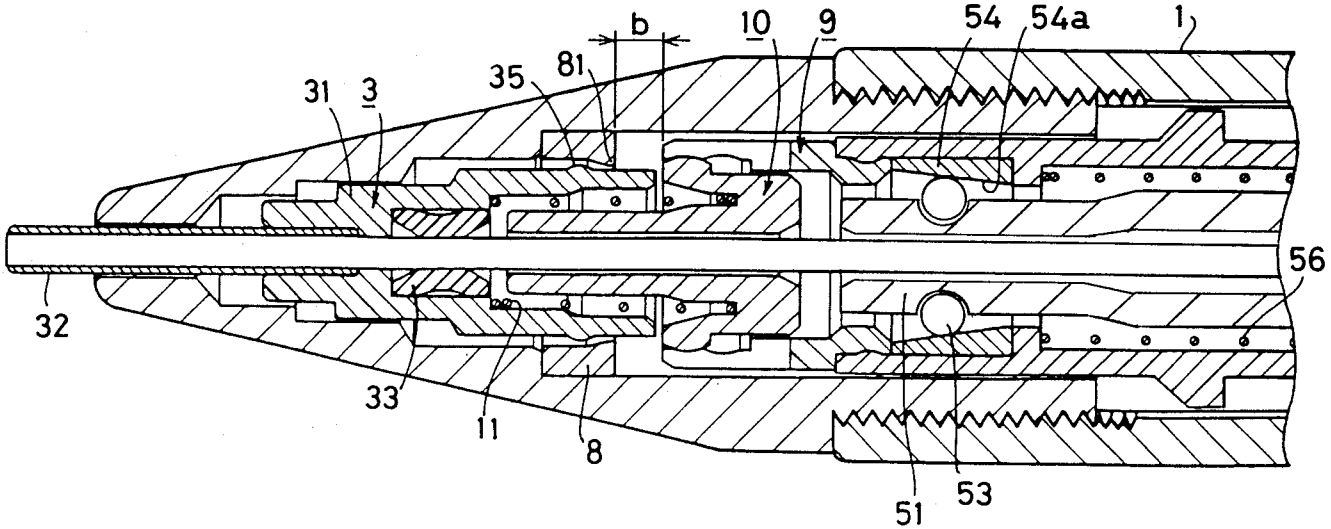

A very long time of writing is required for the abrasion loss of the lead S by writing to become corresponding to the retreat distance b. For example, in writing one Chinese character on wood free paper with a mechanical HB pencil having a lead diameter of 0.5 mm at a writing pressure of an ordinary adult, the lead abrasion loss is only about 0.01 mm. Therefore, it is usually impossible that writing will be continued until the slider retreats the distance b. The writing will surely be discontinued halfway, for example to take a rest. For example, it is here assumed that the writing was discontinued in the state shown in FIG. 27 and the front end of the slide pipe 32 was moved away from the paper surface. As a result, the slider 3 moves forward under the biasing force of the resilient member 11 and the lead S is pulled in the advancing direction together with the slider 3 by a predetermined frictional force exerted thereon from the friction imparting member 20. On the other hand, since the clamping force of the lead chuck which grips the lead S is provided by the second resilient member 56 weaker than the first resilient member 11, the above pulling force in the forward direction of the lead S causes compression, allowing advance of the entire lead chuck 51. As the head portion of the lead chuck 51 moves forward under rolling contact of the balls 53 with the tapered inner wall 54*a* of the metallic cylinder 54, the lead gripping force of the lead chuck 51 becomes weaker, whereby the lead S is fed out. Through a series of these operations the mechanical pencil again reverts to the state of FIG. 25 and thus the lead feed operation is performed automatically. Now, writing can be done continuously to the maximum extent, that is, up to the retreat distance b of the slider 3.

(3) As the third means, the lead can be fed out by front-end knock of pressing the front end of the slider 3 against the paper surface. The front-end knock involves the following two cases, which are different in operation so will be explained separately.

(a) The first type of front-end knock is performed when the lead S is not projecting from the front end of the slide pipe 32 as shown in FIG. 26. By the front-end knock there is obtained the state of FIG. 25 (X=b) in which the lead S is projecting by only the length corresponding to the distance b from the slide pipe 32.

More particularly, as a result of the front-end knock, (1) the slider 3 is moved back by the pressing reaction from the paper surface, and (2) the sleeve as a block (i.e., sleeve 4, lead feed mechanism 5, drum ring 9, ejection bar 10) and the resilient member receiving portion 15 also retreat against the urging force of the third resilient member 12 and the frictional force created between the stopper projections 61 and the sleeve 4. This is because the entire sleeve as a block and the resilient member receiving portion 15 undergo an external force acting in the backward direction as a result of retreat of the lead chuck 51 in a gripping state for the lead S. Since the amount of retreat of the slider 3 and that of the sleeve as a block and the resilient member receiving portion 15 are the same and because of the distance relation a<d, the amount of retreat in question corresponds to the maximum retreatable distance a of the sleeve 4 (that is, the distance at which the sleeve projections 41 are restricted their retreat by the sleeve retreat restricting stepped portion 23*c*) as shown in FIG. 1.

Figure 28:
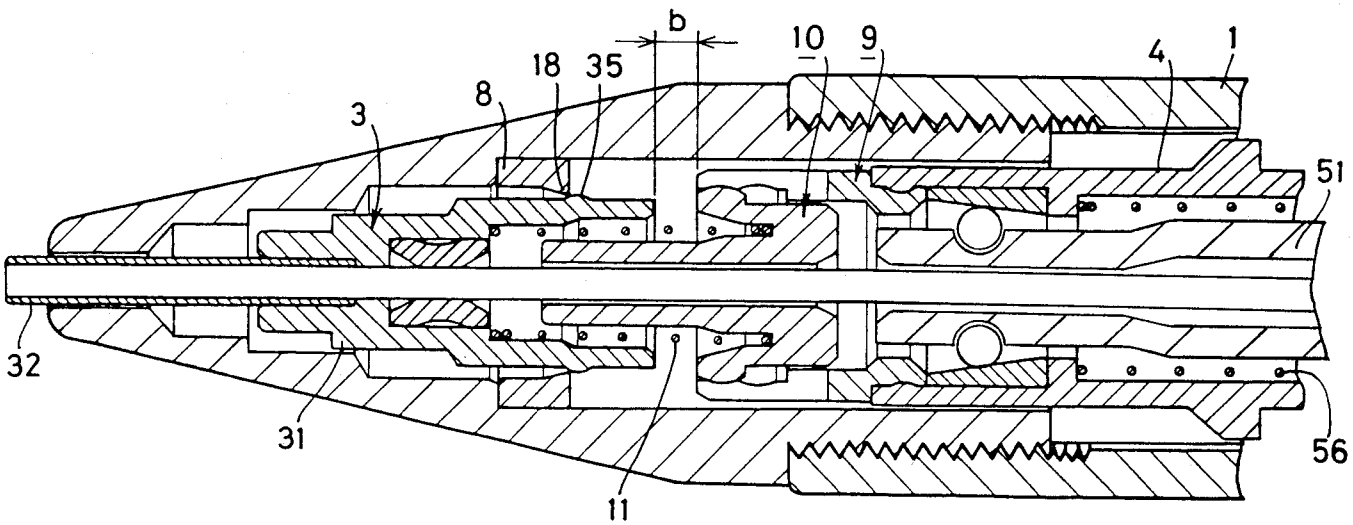

On the other hand, in the retreat of the slider 3 there exists the relation d>a>c among the distances d, a and c, so in the course of backward movement by the distance a which is the maximum retreat distance as mentioned above, the engaging protuberances 35 of the slider body 31 get over the slider stopper 81 of the slider receiving portion 8 and thereafter the rear end of the slider body 31 projects from the rear end of the slider receiving portion 8 as shown in FIG. 28.

Between the rear end of the slider body 31 and the front end 104*f* convex portion of the ejection bar 10 there is maintained the distance b as shown in FIG. 28 because the slider 3 and the sleeve 4 as a block retreat integrally as described above.

Next, when the slider 3 is moved away from the slider-pressed paper surface, the sleeve 4 as a block and the resilient member receiving portion 15 move forward until the front end of the resilient member receiving portion 15 abuts the rear end of the tip member 2 by virtue of the urging force of the third resilient member 12. During this forward movement, the lead chuck 51 holds the lead S grippingly. Further, since the forward urging force of the third resilient member 12 is set larger than the rearward urging force of the first resilient member 11 plus the frictional force developed between the stopper projections 61 and the frictional stepped portions 43, the above forward movement is effected against those opposite external forces.

On the other hand, the slider 3 moves forward under the forward urging force of the first resilient member 11, but as shown in FIG. 28 it is stopped (locked) temporarily by the engaging protuberances 35 of the slider body 31 engaged with the slider stopper 81 of the slider receiving portion 8. Even during this temporary stop of the slider 3, the lead feed mechanism 5 moves forward while gripping the lead S as described above, so the lead S advances with respect to the slider 3 until the front end 104*a* of the convex portion of the ejection bar 10 retained by the concave portion 93*a* which is for retaining the advanced position of the drum ring 9, comes into abutment with the rear end of the slider body 31 to release (unlock) the foregoing temporary stop. The amount of this forward movement is equal to the distance b.

Therefore, by this first front-end knock there is obtained the state of FIG. 25 (X=b) in which the lead S is projecting by the length b from the front end of the slide pipe 32.

(b) Next, the second front-end knock is performed in a projecting state of the lead S from the front end of the slide pipe 32, as shown in FIG. 25.

In this case, if there is the relation X≦distance a - distance c between the amount of projection X and the distance a - distance c, the lead S is projecting by the length of X+b from the slide pipe 32.

For ease of understanding, explanation will now be made under the substitution of concrete numerical values. For example, it is assumed that b=0.8 mm, c=1.3 mm, a=1.7 mm and X=0.3 mm (<a−d=0.4 mm). If front-end knock is performed in this state, the sleeve 4 as a block and the resilient member receiving portion 15 retreat together with the lead S up to the retreat distance X corresponding to the amount of projection from the front end of the slide pipe 3 against the urging force of the third resilient member 12 and the frictional force between the stopper projections 61 and the frictional stepped portions 43.

Thereafter, the slider 3 moves back together with the sleeve 4 as a block and the resilient member receiving portion 15 in the same manner as, in the first front-end knock. Thus, the sleeve 4 as a block is larger in the amount of retreat by X=0.3 mm in comparison with the slider 3. In other words, the slider 3 can move back a distance of only a−X=1.7 mm−0.3 mm=1.4 mm in relation to the sleeve 4 whose retreat is restricted by the sleeve retreat restricting stepped portions 23*c*. In the course of this backward movement, the engaging protuberances 35 of the slider 3 get over the slider stopper 81 of the slider receiving portion 8.

Since the amount of retreat of the sleeve 4 as a block is larger by X=0.3 mm than that of the slider 3 as mentioned above, the distance between the front end 104*a* of the convex portion of the ejection bar 10 and the rear end of the slider body 31 becomes b+X.

Next, when the slider 3 is moved away from the slider-pressed paper surface, the sleeve 4 as a block advances while gripping the lead S in the same manner as in the above first front-end knock.

On the other hand, the slider 3 is stopped (locked) temporarily by the slider stopper 81 engaged with the engaging protuberances 35.

Thereafter, the lead S is projected with respect to the slider 3 in just the same manner as in the first front-end knock. That is, since the lead feed mechanism 5 advances while gripping the lead S even during the temporary stop of the slider 3, the lead S advances with respect to the slider 3 until the front end 104*a* of the convex portion of the ejection bar 10 abuts the rear end of the slider body 31 to release (unlock) the above temporary stop. The amount of this forward movement is equal to b+X as mentioned above.

Thus, as a result of the second front-end knock the mechanical pencil reverts to the state shown in FIG. 25 in which the lead S is projecting by the length of X+b from the front end of the slide pipe 32.

On the other hand, in the case of $X>a-c=0.4$ mm, the slider 3 is prevented from retreating to the position of engagement with the slider stopper 81 by the sleeve 4 whose retreat is restricted by the sleeve retreat restricting stepped portions 23c. Consequently, the temporary stopped state of the slider 3 in engagement with the slider stopper 81 of the slider receiving portion 8 cannot occur, so the above adjustment of the amount of projection is not performed. That is, no matter how many times the front-end knock is repeated, it is a mere repetition of front-end knock not involving the feed of lead, so the lead S is kept projecting without change in its projecting length X.

The above three types of lead feed operations can be performed. During writing, the sleeve 4 as a block, including the lead feed mechanism 5 which grips the lead S, and the resilient member receiving portion 15, are urged forward by the third resilient member 12. Therefore, if excess writing pressure should act on the lead S during writing, the sleeve 4 as a block and the resilient member receiving portion 15 retreat while compressing the third resilient member 12. Thus, this mechanical pencil has an excess writing pressure damping function.

Figure 29:
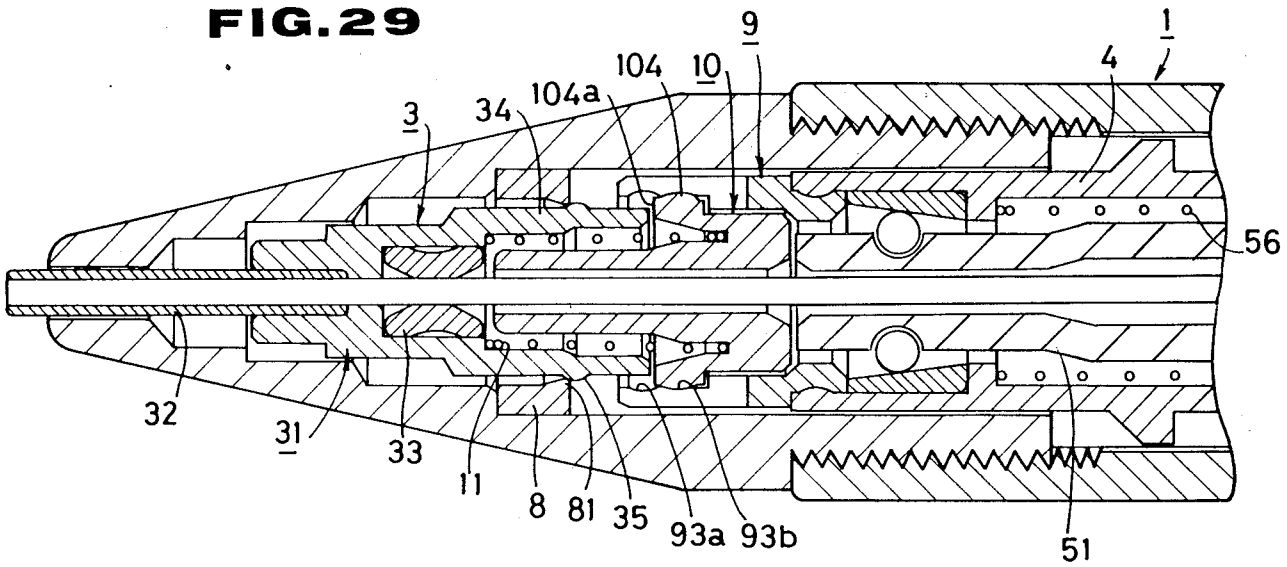

Explanation will be made below about the locking and stowing operation for the slider 3 in the mechanical pencil of the present invention with reference to FIGS. 1 and 29.

In an unlocked state of the slider 3, the rear end of the lead pipe 13 is knocked (in this case the lead chuck 51 opens to release the lead S and hence the sleeve 4 as a block is not in its rear position unlike the above front-end knock) and the slide pipe 32 is pressed against the surface of paper or the like, so that the slider 3 retreats while compressing the first resilient member 11. In the course of this backward movement, the rear end of the slider 3 pushes the ejection bar 10 backward. The pressing force of the slider 3 against the paper surface is larger than the engaging force between the convex portion 104 of the ejection bar 10 and the concave portion 93a of the drum ring 9, and the forward biasing force of the third resilient member 12 is larger than the said engaging force, so the ejection bar 10 alone is pushed backward and, as shown in FIG. 29, the convex portion 104 of the ejection bar 10 comes into engagement with the retreat-position retaining concave portion 93b of the drum ring 9 and is retained in its retreated position.

By such backward movement of the ejection bar 10 there is ensured a receptable portion serving as a locked stowing space for the slider 3. As a result, when the slider 3 is stowed in a locked state, only an extremely small part of the slide pipe 32 projects from the front end of the tip member 2. Thus, an efficient locking and stowing operation for the slider 3 can be effected.

The following is an explanation about the operation for releasing the locked stow of the slider 3 and for the feed of lead.

It is only rear-end knock that is required for the operation just mentioned above. Upon knocking of the rear end, the sleeve 4 and the lead feed mechanism 5 advance together and the rear end of the slider 3 is pressed forward strongly by the front end 104a of the convex portion of the ejection bar 10 to release the engagement between the engaging protuberance 35 of the slider 3 and the slider stopper 81 (release the locked stow). At the same time, the lead is fed by rear-end knock. Thereafter, the slider 3 is returned to the state of FIG. 25 by the first resilient member 11, now ready for writing. The front end 104a of the convex portion of the ejection bar 10 is also pushed by the front end of the lead chuck 51 and is thereby moved forward to the concave portion 93a on the front side of the drum ring 9 as shown in FIG. 25.

The following description is now provided about a second embodiment of the present invention.

In the first embodiment described above, the ejection bar 10 is retained movably to the two predetermined positions of advanced and retreated positions by the two retaining concave portions 93a and 93b within the drum ring 9, and it is made slidable within the drum ring; further, three types of lead feed operations can be adopted and it is made possible to effect locked stow of the slider 3.

In the second embodiment of the invention, the ejection bar 10 is fixed to the position of the advanced-position retaining concave portion 93a in the drum ring 9, or in this position the ejection bar 10 and the drum ring 9 are integrally formed. In this second embodiment, therefore, it is impossible to effect the locked stow of the slider 3, but the lead feed operation and other operations are just the same as in the first embodiment.

Figure 30:
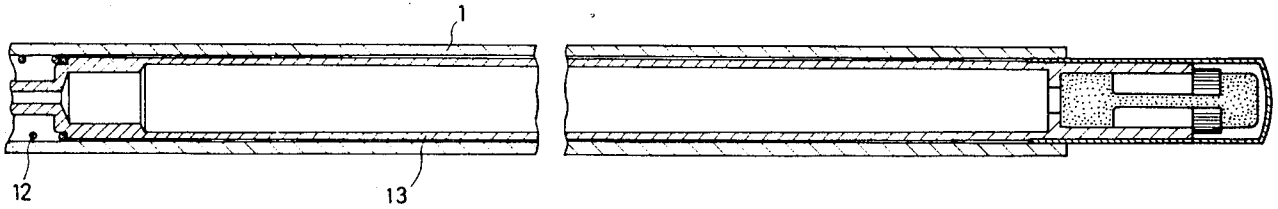
FIG. 30 is a longitudinal sectional view of a shell portion according to a third embodiment of the present invention.

FIG. 30 illustrates a third embodiment in which the coupling 7 and the lead pipe 13 are integrally formed.

In the first embodiment, though not shown, the chuck opening/closing mechanism 14 at the front end of the lead pipe 13 may be omitted and instead the front end of the lead pipe 13 may be removably attached to or press-fitted into the coupling 7 directly.

Figure 31:
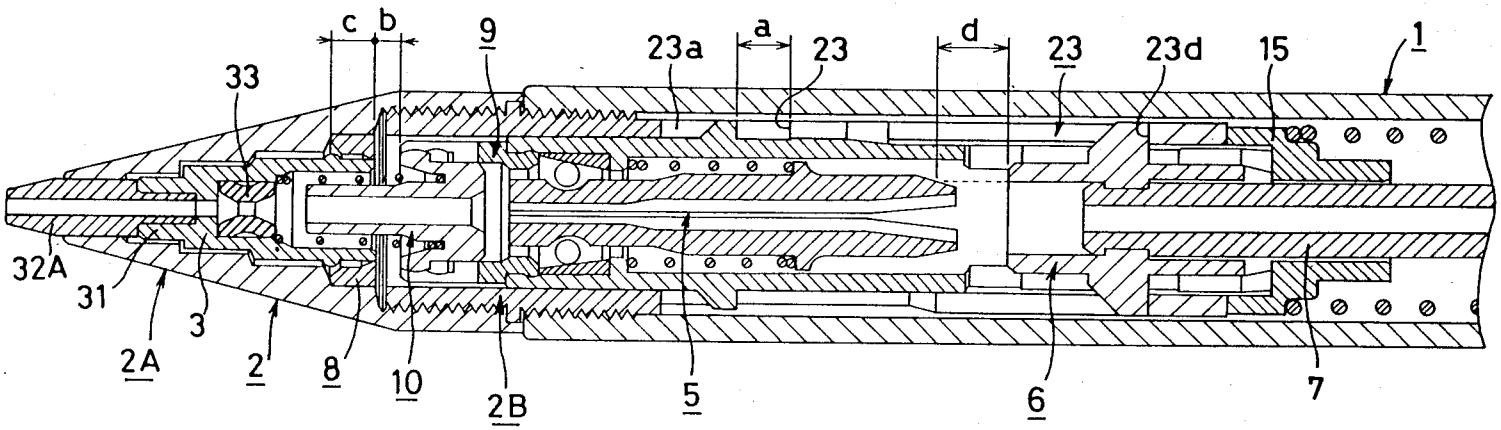
FIG. 31 is a longitudinal sectional view of a fourth embodiment.

Referring now to FIG. 31, there is illustrated a fourth embodiment of the present invention, in which the tip member 2 is formed as a bisplit body comprising a tip member body 2A and a connecting cylinder 2B. The connecting cylinder 2B is provided on the front end side thereof with a tip member connecting portion $21B_1$ and a shell connecting portion $21B_2$. Contiguous to the rear end of the shell connecting portion $21B_2$ is a rear cylindrical portion 22B having the same structure as the rear cylindrical portion 22 described in the embodiment of FIG. 1. That is, the rear cylindrical portion 22B has the paired sliding slots 23 and slits 24 shown in FIGS. 1 to 5. And the paired sliding slots 23 are each provided with a sleeve projection sliding slot 23a, a stopper projection sliding slot 23b and a sleeve retreat restricting stepped portion 23c.

Further, a slide tip 32A formed, for example, by turnery and having a diameter larger than that of the slide pipe 32 of the slider 3 shown in FIG. 1 is fitted in the front end of the slider body 31.

According to the first, third and fourth embodiments of the present invention, as set forth hereinabove, the components of the mechanical pencil other than the shell are constructed in the unit of blocks whereby the assembling work, etc. can be simplified, the number of components required is reduced, and the components can be used efficiently for various purposes. Moreover, since the lead is covered with components such as the ejection bar at all times, it is possible to prevent breakage of the lead, etc. and attain the stabilization of quality. Further, three types of lead feed operations can be done; the slider locking and stowing operation and the release of the locked stow can be effected easily; and there does not occur such an inconvenience as the lead being fed out inadvertently while one carries it with him.

The following description is now provided about a mechanical pencil according to a fifth embodiment of the present invention having a lead stopper capable of undergoing elastic deformation in the radial direction in an assembled state.

Figure 32:
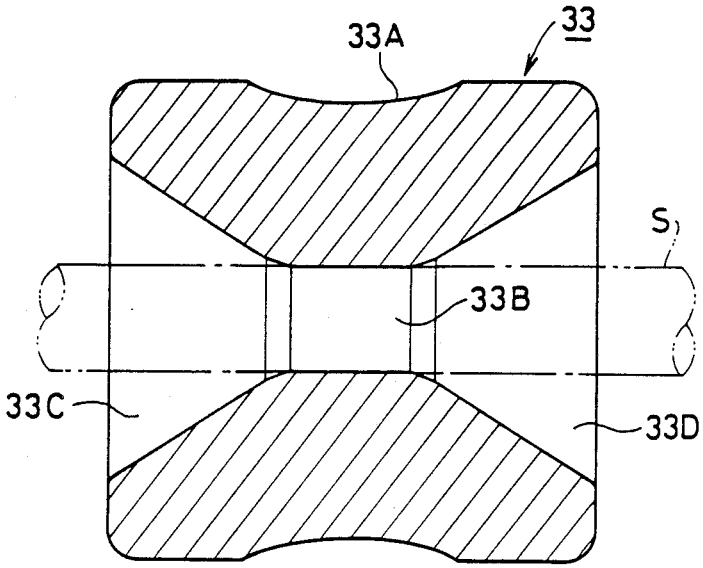
FIG. 32 is a sectional view of a lead stopper according to a fifth embodiment of the present invention.
Figure 33:
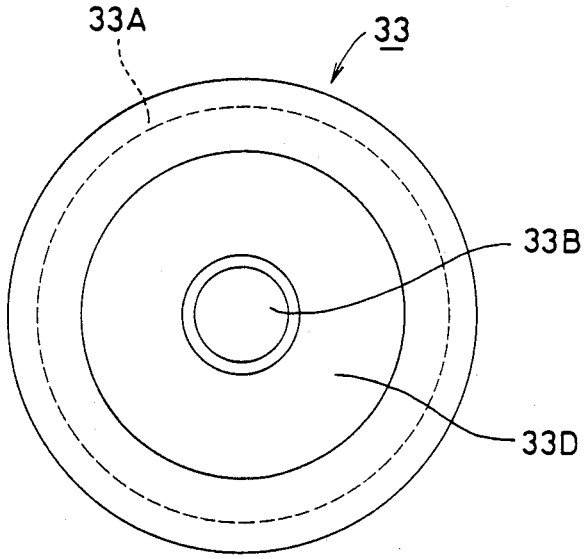
FIG. 33 is an end view of FIG. 32.

As shown in FIG. 32, a friction imparting member 33 which constitutes a lead stopper is obtained by forming rubber or synthetic resin integrally into a cylindrical shape like known ones. The friction imparting member 33 has an annular recess 33A formed along the central part of its outer peripheral surface.

It also has a lead insertion hole 33B extending through the center thereof to impart a predetermined frictional force to the lead S. The lead insertion hole 33B is coaxially formed with a front tapered hole 33C having a larger diameter on the front end side thereof and a rear tapered hole 33D having a larger diameter on the rear end side thereof.

Thus, in the friction imparting member 33, the front and rear ends on both sides of the recess 33A are of the same outside diameter, presenting a shape having no axial directionality.

The friction imparting member 33 of the above construction can be formed easily because it has no directionality as mentioned above. Besides, it can be easily mounted into the mechanical pencil shown in FIG. 34 or 35.

Figure 34:
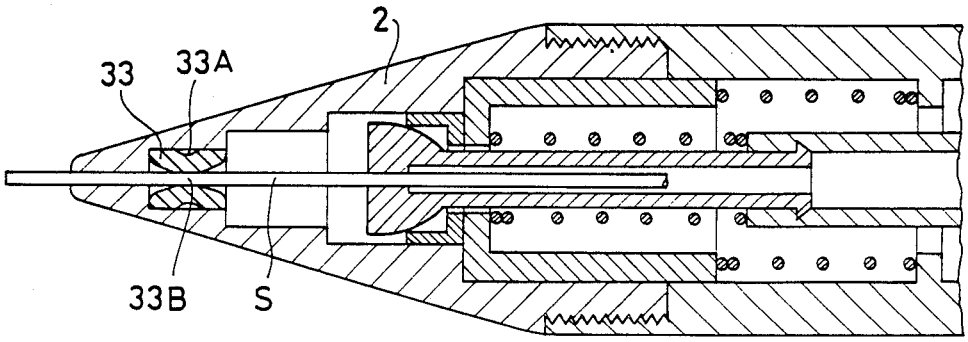
FIGS. 34 and 35 are partial sectional views of different mechanical pencils each having a lead stopper incorporated therein.
Figure 35:
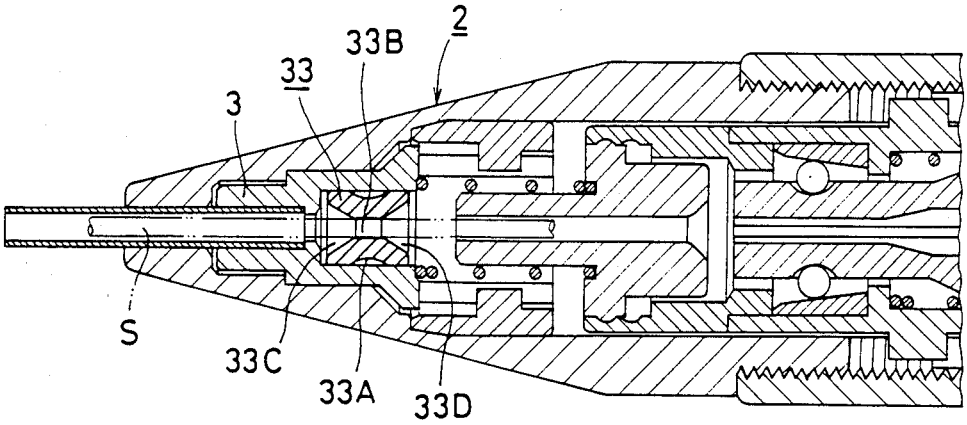

More specifically, in the case of the mechanical pencil shown in FIG. 34, the friction imparting member 33 is press-fitted into the tip member 2 of the mechanical pencil, while in the case of FIG. 35, the friction imparting member 33 is press-fitted into the slider 3 which is axially slidable within the tip member 2.

In such an assembled state, the front and rear outer peripheral surfaces except the recess 33A of the friction imparting member 33 are held in gap-free frictional engagement with the inner peripheral surface of the tip member 2 in the case of FIG. 34 or with the inner peripheral surface of the slider 3 in the case of FIG. 35. And in both cases, an annular gap portion is formed between the inner peripheral surface of the tip member 2 or of the slider 3 and the recess 33A.

Therefore, the friction imparting member 33 in the above assembled state can be deformed elastically in the diameter expanding direction through the recess 33A thereof, so its expansion which occurs upon insertion of the lead S into the lead insertion hole 33B due to axial and radial variations of the tip member 2 or the slider 3, variations in the lead diameter, or radial variations of the friction imparting member 33 itself, can be absorbed by elastic deformation in the diameter expanding direction of the recess 33A.

Thus, by absorbing the above variations through the recess 33A of the lead stopper there can be attained an outstanding effect particularly when this structure is applied to, for example, the slider of an automatic mechanical pencil disclosed in Japanese patent application No. 57491/86 filed previously by the applicant in the present case.

In the mechanical pencil of the above prior application, the feed of lead is conducted automatically upon release of the writing pressure of the slider from the surface of paper or the like and, for such automatic lead feed upon release of the writing pressure, a lead gripping lead chuck permits easy advance of the lead but inhibits its retreat. Since friction imparting force of the friction imparting member for the lead during advance of the lead and that during retreat of the lead are different from each other, the feed of the lead can be effected smoothly and positively by using the above lead stopper as the friction imparting member.

Thus, according to the fifth embodiment, the lead stopper for imparting a predetermined frictional force to the lead to be fed out of the mechanical pencil is formed in a cylindrical shape having the same outside diameter throughout the overall length thereof, and a recess is formed along the central part of the outer peripheral surface of the lead stopper. Consequently, axial and radial variations of the tip member or the slider of the mechanical pencil attached to the lead stopper, as well as variations of the lead stopper itself, can be absorbed by the above recess. Besides, since the lead stopper has no directionality, it can be formed and mounted easily.

Figure 36A:
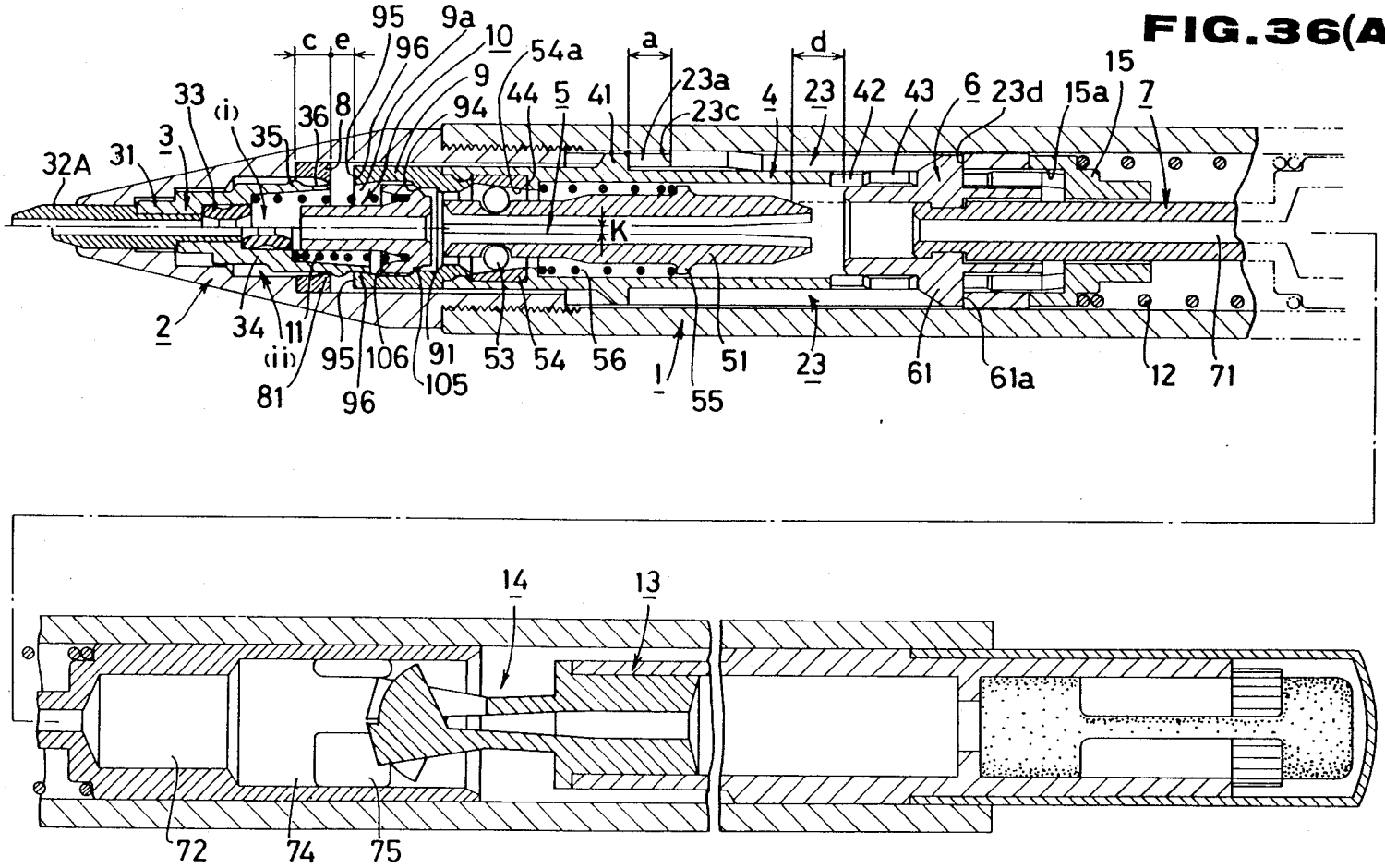
FIG. 36(A) is a longitudinal sectional view of a sixth embodiment.
Figure 36B:
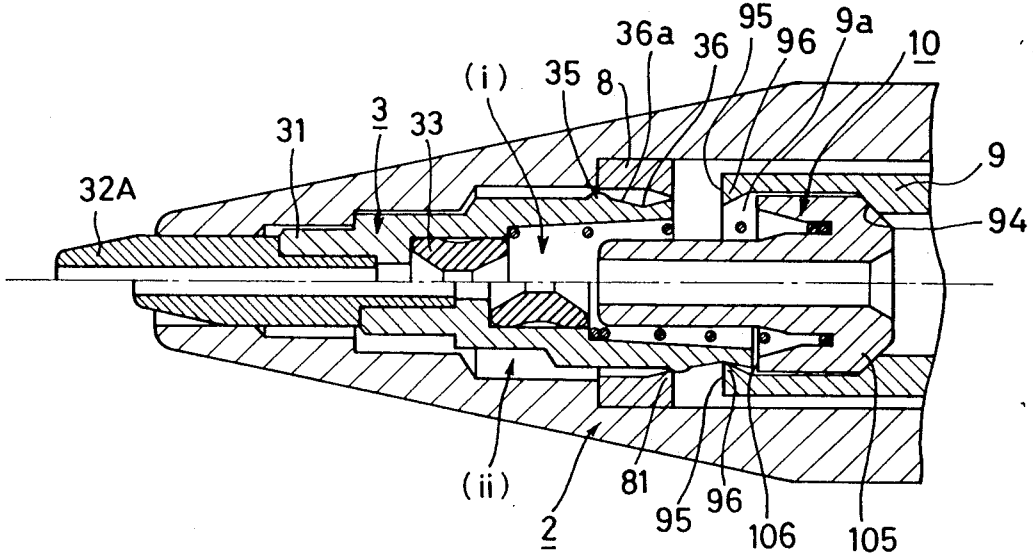
FIG. 36(B) is a longitudinal sectional view of a principal portion thereof.
Figure 39:
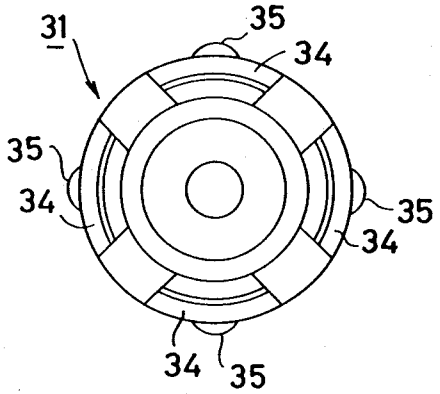
FIG. 39 is a rear view of FIG. 37.
Figure 37:
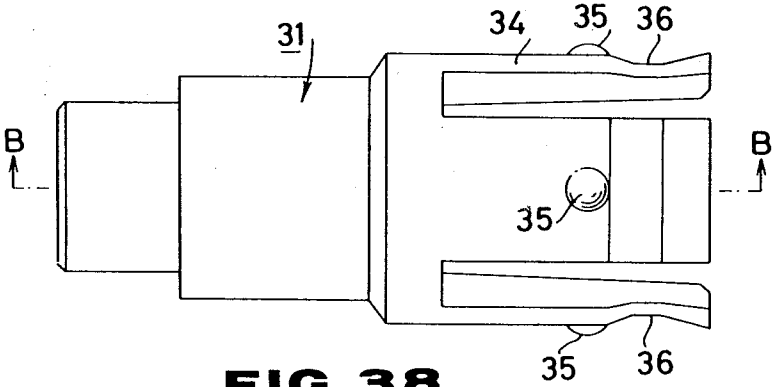
FIG. 37 is a plan view of a slider.
Figure 38:
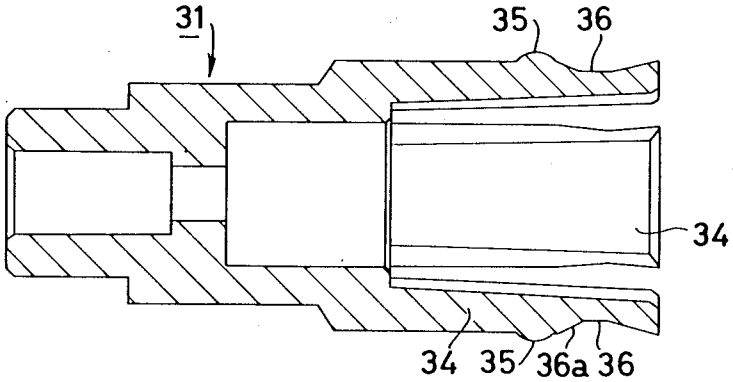
FIG. 38 is a sectional view taken on line B—B of FIG. 37.

Referring now to FIG. 36, there is illustrated a mechanical pencil in section according to a sixth embodiment of the present invention. Portions different from the foregoing first embodiment will be explained. In this sixth embodiment, slider 3, drum ring 9 and ejection bar 10 are slightly different in construction from those described in the first embodiment. More specifically, FIGS. 37 to 39 illustrate a structure of the slider 3, in which the numeral 36 denotes an engaging recess which comes into engagement with a front-end engaging portion 96 (FIG. 40) of the drum ring 9 at the time of locking and stowing of the slider 3, and the numeral 36*a* denotes an inclined surface. The engaging recess 36 and the inclined surface 36*a* formed as portions of each engaging piece 34 of the slider 3.

Figure 40:
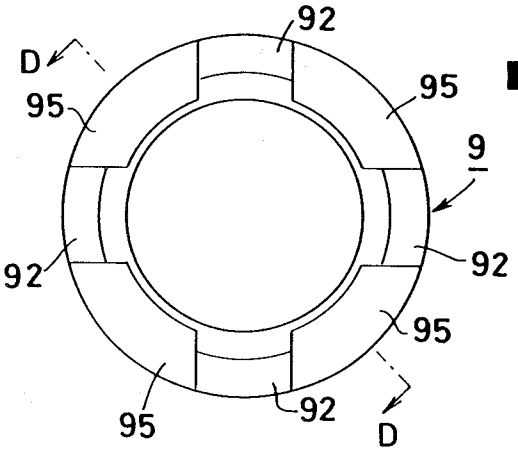
FIG. 40(A) is a front view of a drum ring.
FIG. 40(B) is a sectional view taken on line D—D of FIG. 40(A)
Figure 40:
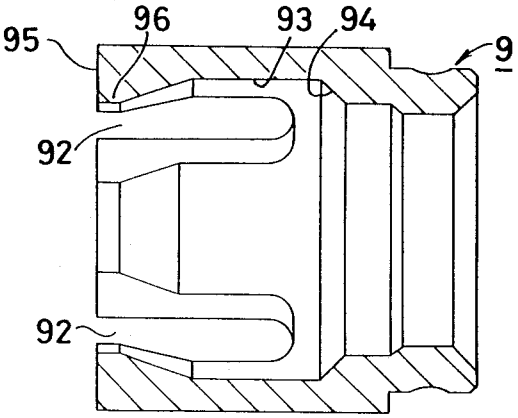

In addition to the two functions explained in the first embodiment, the drum ring 9 has a further function of receiving in its receptacle portion 9*a* the vicinity of the rear end of the slider 3 at the time of locking and stowing of the slider and engaging the slider through the engaging recesses 36. As shown in FIG. 40, the numeral 94 denotes a stepped inner wall portion to restrict the backward movement of the ejection bar 10 and the numeral 95 denotes a front end wall portion. As will be described later, the front end wall portion 95 (1) functions to push and abut the rear end of the slider 3 at the time of front-end knock to release the knock and (2) also functions to release the locked stowing of the slider 3. Numeral 96 represents the front-end engaging portion as referred to above.

Between the front end (front end wall portion) 95 of the drum ring 9 and the rear end of the slider receiving portion 8 there is a distance e which corresponds to the lead feed quantity at the time of rear- and front-end knock as well as an automatic writing continuable distance.

Figure 41:
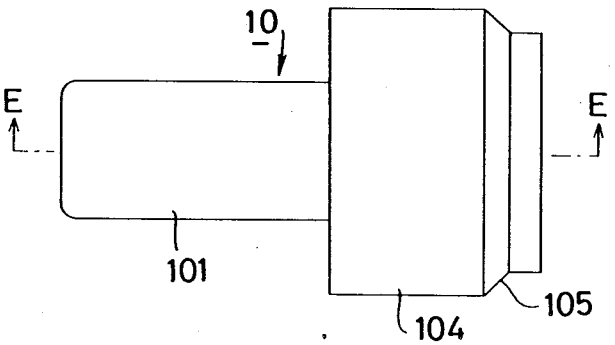
FIG. 41(A) is a plan view of an ejection bar.
FIG. 41(B) is a sectional view taken on line E—E of FIG. 41(A)
Figure 41:
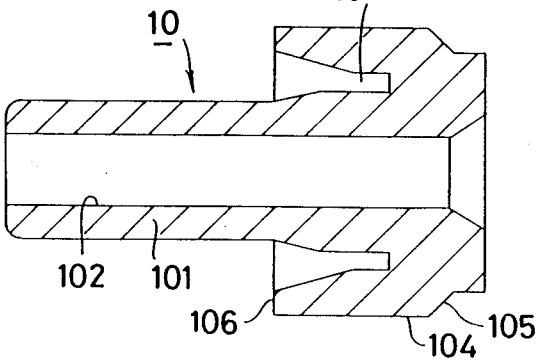

The ejection bar 10, as shown in FIG. 41, has an outer peripheral wall portion 104 received movably along the inner wall portion 93 of the drum ring 9, and a rear stepped portion 105 positioned behind the outer peripheral wall portion 104 and adapted to abut the stepped inner wall portion 94 of the drum ring 9 to restrict the backward movement, in addition to the bar body 100, cylindrical portion 101, lead insertion hole 102 and the retaining portion 103 which were explained in the first embodiment. Numeral 106 denotes a front end wall portion.

In this embodiment, moreover, the urging force A of the first resilient member 11, the frictional force B of the friction imparting member 33 to the lead S, and the gripping force C of the lead chuck 51 for the lead S, are in the following relations.

① B>A If this relation is not satisfied at the time of front-end knock as will be described later, there will occur lead slip between the friction imparting member 33 and the lead S.

② A>C This is because it is necessary to pull out the lead S forward from the lead chuck 51 with advance of the slider 3 at the time of later-described front-end knock and so-called automatic writing.

Among the foregoing distances a, c and d there is the relation of d>a>c.

In FIG. 39, any one pair of two pairs of opposed engaging protuberances 35 may be omitted.

The assembling operation for the mechanical pencil of this sixth embodiment is the same as that described in the first embodiment.

The lead feed operation is also the same as in the first embodiment; that is, three types of lead feed operations can be performed which are rear-end knock, automatic lead feed by interruption of writing, and front-end knock.

The rear-end knock is just the same as in the first embodiment, but the automatic lead feed as the second means and the front-end knock as the third means are performed at the front end of the drum ring 9 unlike the first embodiment, so this point will be explained below.

The automatic lead feed operation, which is performed by the interruption of writing, will first be explained.

Figure 42:
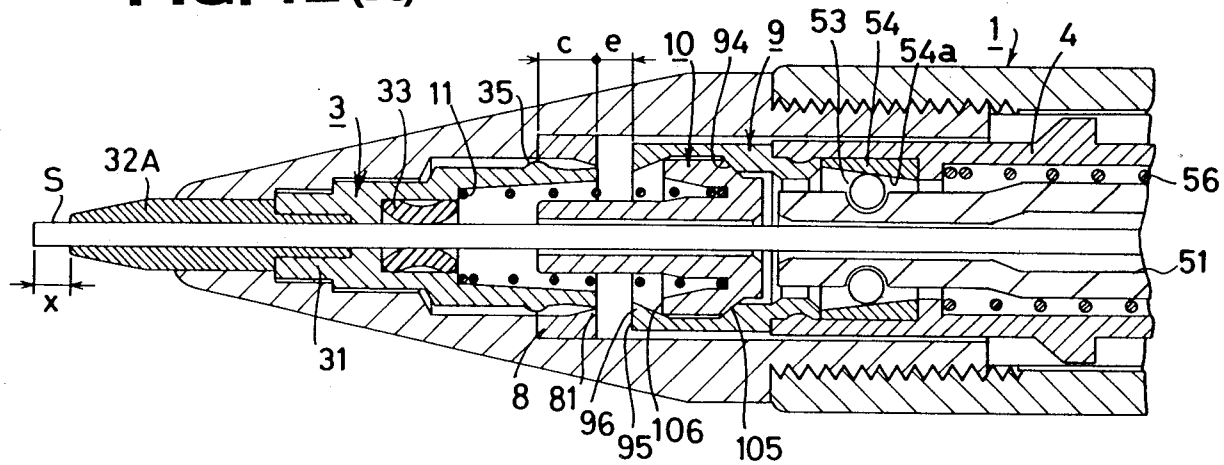
FIG. 42 is an explanatory view of automatic writing, front-end knock and lock/stow operations of the slider.
Figure 42:
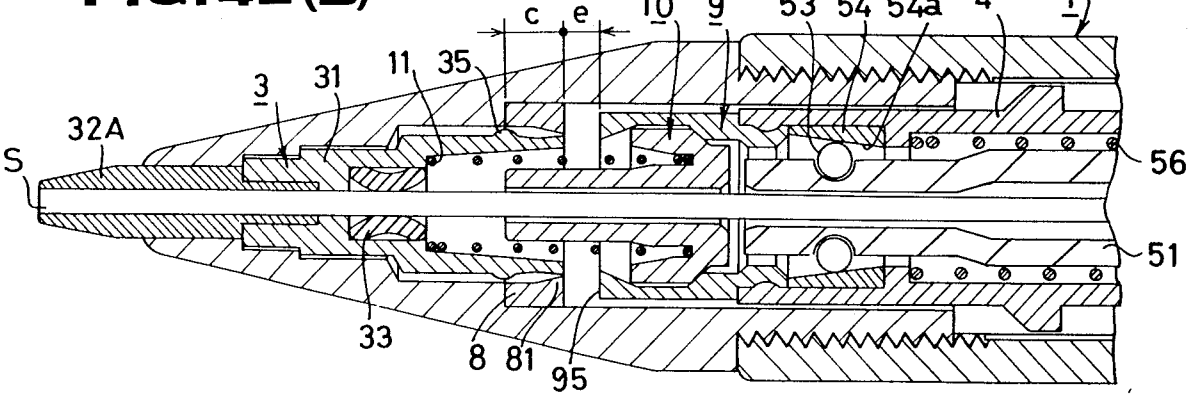
Figure 42C:
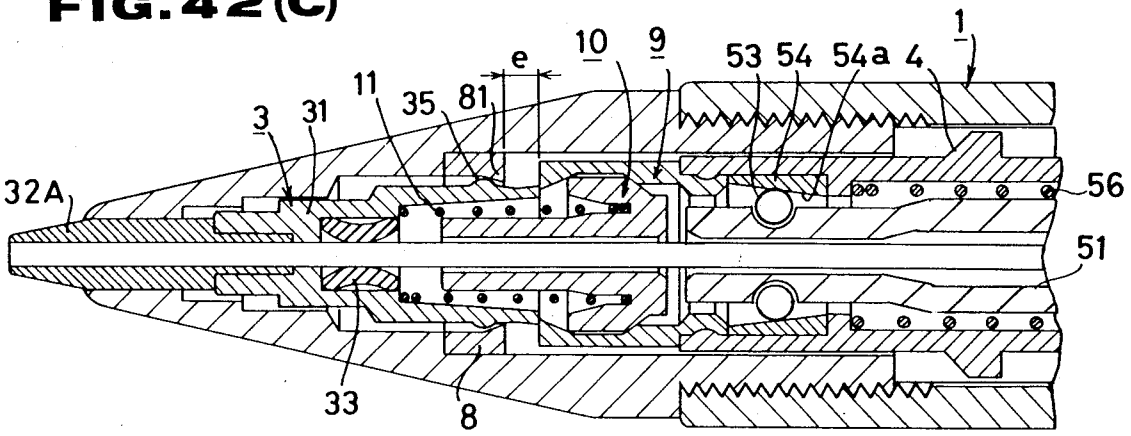

Writing is usually performed in a projecting state of the lead S by a predetermined amount X from the slide tip 32A, as shown in FIG. 42(A). As writing proceeds, the lead S wears little by little until it become flush with the front end of the slide tip 32A, as shown in FIG. 42(B). Even in this state, the slider 3 can retreat against the urging force of the first resilient member 11. Its maximum retreatable distance is up to abutment with the front end wall portion 95 of the drum ring 9, that is, up to the retreat distance e shown in FIGS. 1, 42(B) and 42(C). Other operations are the same as in the first embodiment so will not be explained here.

Explanation will now be made about the lead feed operation using front-end knock as the third means whereby the front end of the slider 3 is pressed against the paper surface. Like the first embodiment, the front-end knock involves the following two cases, which are different in operation so will be explained separately.

(a) The first type of front-end knock is performed in a state wherein the lead S is not projecting from the front end of the slide tip 32A, as shown in FIG. 42(B). By front-end knock there is obtained the state of FIG. 42(A) (X=e) wherein the lead S is projecting a length equal to the distance e from the slide tip 32A.

More specifically, when front-end knock is performed, ① the slider 3 is moved back by the pushing reaction from the paper surface, and ② the sleeve as a block (i.e., sleeve 4, lead feed mechanism 5, drum ring 9, ejection bar 10) and the resilient member receiving portion 15 also retreat against the urging force of the third resilient member 12 and the frictional force created between the stopper projections 61 and the frictional stepped portions 43 of the sleeve 4. This is because the entire sleeve as a block and the resilient member receiving portion 15 undergo an external force acting in the backward direction as a result of retreat of the lead chuck 51 in a gripping state for the lead S. Since the amount of retreat of the slider 3 and that of the sleeve as a block and the resilient member receiving portion 15 are the same and because of the distance relation a<d, the amount of retreat in question corresponds to the maximum retreatable distance a of the sleeve 4 (that is, the distance at which the sleeve projections 41 are restricted their retreat by the sleeve retreat restricting stepped portion 23c) as shown in FIG. 1.

Figure 42D:
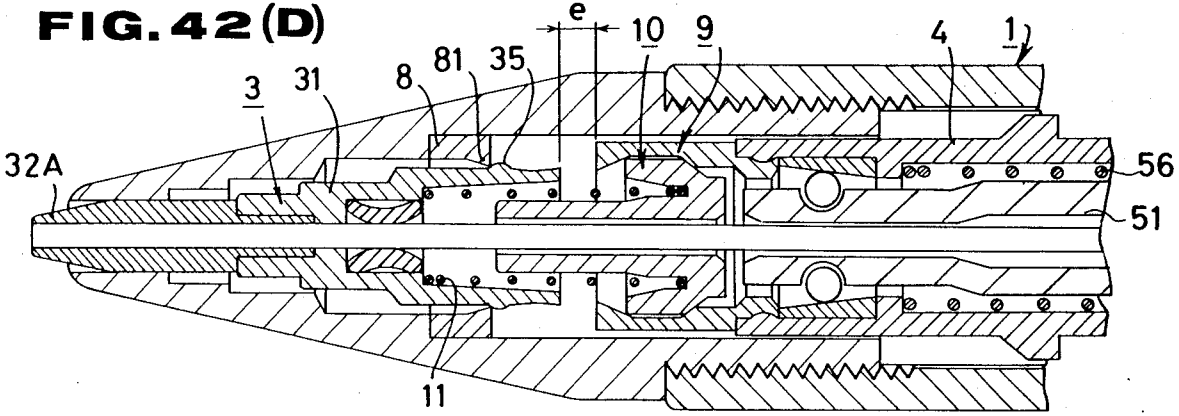

On the other hand, in the retreat of the slider 3 there exists the relation d>a>c among the distances d, a and c, so in the course of backward movement by the distance a which is the maximum retreat distance as mentioned above, the engaging protuberances 35 of the slider body 31 get over the slider stopper 81 of the slider receiving portion 8 and thereafter the rear end of the slider body 31 projects from the rear end of the slider receiving portion 8 as shown in FIG. 42(D).

Between the rear end of the slider body 31 and the front end (front end wall portion) 95 of the drum ring 9 there is maintained the distance e as shown in FIG. 42(D) because the slider 3 and the sleeve 4 as a block retreat integrally as described above.

Next, when the slider 3 is moved away from the slider-pressed paper surface, the sleeve 4 as a block and the resilient member receiving portion 15 move forward until the front end of the resilient member receiving portion 15 abuts the rear end of the tip member 2 by virtue of the urging force of the third resilient member 12. During this forward movement, the lead chuck 51 holds the lead S grippingly. Further, since the forward urging force of the third resilient member 12 is set larger than the rear urging force of the first resilient member 11 plus the frictional force developed between the stopper projections 61 and the frictional stepped portions 43, the above forward movement is effected against those opposite external forces.

On the other hand, the slider 3 moves forward under the forward urging force of the first resilient member 11, but as shown in FIG. 42(D), it is stopped (locked) temporarily by the engaging protuberances 35 of the slider body 31 engaged with the slider stopper 81 of the slider receiving portion 8. Even during this temporary stop of the slider 3, the lead feed mechanism 5 moves forward while gripping the lead S as described above, so the lead S advances with respect to the slider 3 until the front end wall portion 95 of the drum ring 9 abuts the rear end of the slider body 31 to release (unlock) the foregoing temporary stop. The amount of this forward movement is equal to the distance e.

Threfore, by this first front-end knock there is obtained the state of FIG. 42(A) (X =e) in which the lead S is projecting by the length c from the front end of the slide tip 32A.

(b) Next, the second front-end knock is performed in a projecting state of the lead S from the front end of the slide tip 32A, as shown in FIG. 42(A).

In this case, if there is the relation of X≦distance a - distance c between the amount of projection X and the distance a - distance c, the lead S is projecting by the length of X+e from the slide tip 32A.

For ease of understanding, explanation will now be made under the substitution of concrete numerical values. For example, it is assumed that e=0.8 mm, c=1.3 mm, a=1.7 mm and X=0.3 mm (<a−d=0.4 mm). If front-end knock is performed in this state, the sleeve 4 as a block and the resilient member receiving portion 15 retreat together with the lead S up to the retreat distance X corresponding to the amount of projection from the front end of the slide tip 32A against the urging force of the third resilient member 12 and the frictional force between the stopper projections 61 and the frictional stepped portions 43.

Thereafter, the slider 3 moves back together with the sleeve 4 as a block and the resilient member receiving portion 15 in the same manner as in the first front-end knock. Thus, the sleeve 4 as a block is larger in the amount of retreat by X=0.3 mm in comparison with the slider 3. In other words, the slider 3 can move back a distance of only a−X=1.7 mm−0.3 mm=1.4 mm in relation to the sleeve 4 whose retreat is restricted by the sleeve retreat restricting stepped portions 23c. In the course of this backward movement, the engaging protuberances 35 of the slider 3 get over the slider stopper 81 of the slider receiving portion 8.

Since the amount of retreat of the sleeve 4 as a block larger by X=0.3 mm than that of the slider 3 as mentioned above, the distance between the front end wall portion 95 of the drum ring 9 and the rear end of the slider body 31 becomes e+X.

Next, when the slider 3 is moved away from the slider-pressed paper surface, the sleeve 4 as a block advances while gripping the lead S in the same manner as in the above first front-end knock.

On the other hand, the slider 3 is stopped temporarily by the slider stopper 81 engaged with the engaging protuberances 35.

Thereafter, the lead S is projected with respect to the slider 3 in just the same manner as in the first front-end knock. That is, since the lead feed mechanism 5 advances while gripping the lead S even during the temporary stop (locked state) of the slider 3, the lead S advances with respect to the slider 3 until the front end wall portion 95 of the drum ring 9 abuts the rear end of the slider body 31 to release (unlock) the foregoing temporary stop. The amount of this forward movement is equal to e +X.

Thus, as a result of the second front-end knock the mechanical pencil reverts to the state shown in FIG. 42(A) in which the lead S is projecting by the length of X+e from the front end of the slide tip 32A.

On the other hand, in the case of X>a−c=0.4 mm, the slider 3 is prevented from retreating to the position of engagement with the slider stopper 81 by the sleeve 4 whose retreat is restricted by the sleeve retreat restricting stepped portions 23c. Consequently, the temporary stopped state of the slider 3 in engagement with the slider stopper 81 of the slider receiving portion 8 cannot occur, so the above adjustment of the amount of projection is not performed. That is, no matter how many times the front-end knock is repeated, it is a mere repetition of front-end knock not involving the feed of lead, so the lead S is kept projecting without change in its projecting length X.

In this embodiment, as described above, the engagement of the slider 3 with the slider receiving portion 8 is released by pressure abutment of the front end wall portion 95 of the drum ring 9 with the slider 3, so the front-end knock is ensured if slide pipe 32 is projecting from the tip member 2.

Further, if excess writing pressure should act on the lead S during writing, the sleeve 4 as a block and the resilient member receiving portion 15 retreat while compressing the third resilient member 12. Thus, this mechanical pencil has an excess writing pressure damping function like the first embodiment.

Figure 42E:
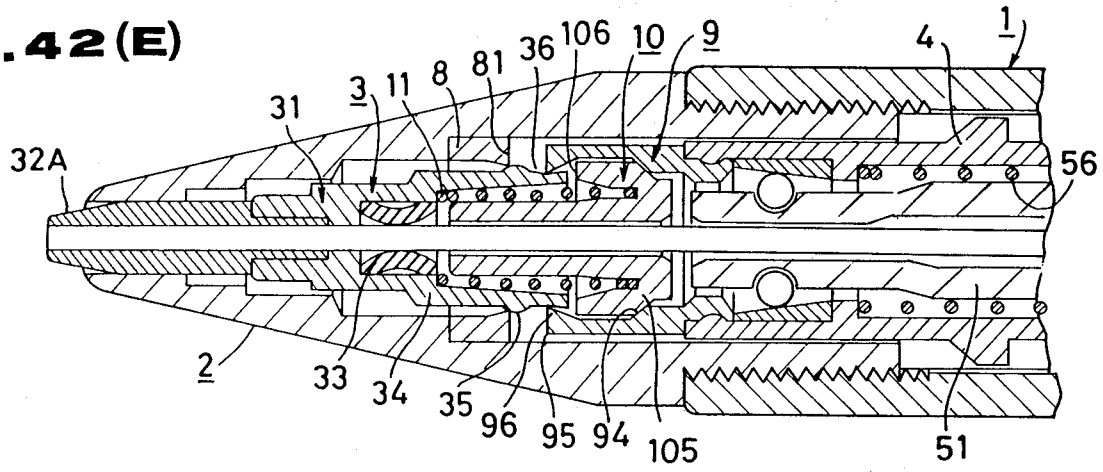
Figure 42F:
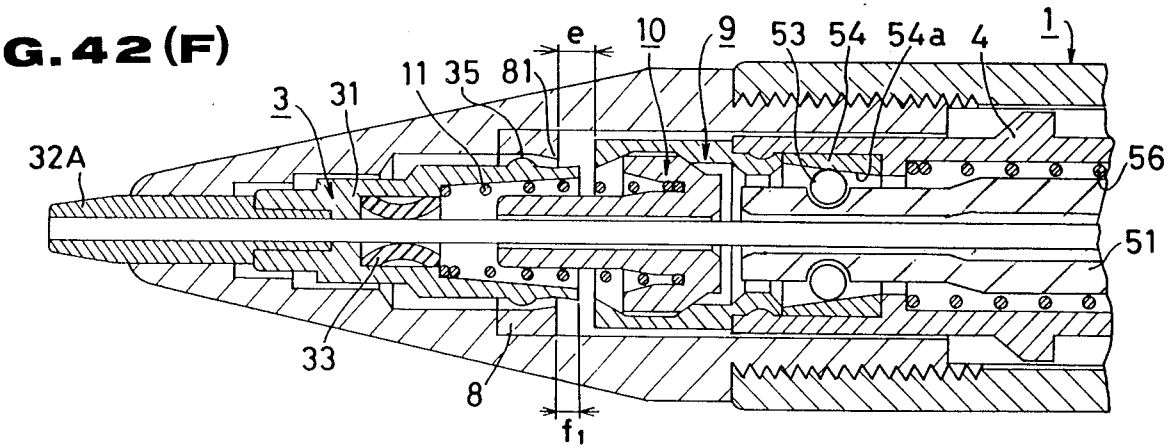

The following description is now provided about the locking and stowing operation for the slider 3 with reference to FIGS. 36 and 42(E).

In an unlocked state of the slider 3, the rear end of the lead pipe 13 is knocked (rear-end knock) (in this case the lead chuck 51 opens to release the lead S and hence the sleeve 4 as a block is not in its rear position unlike the above front-end knock) and the slide pipe 32 is pressed against the surface of paper or the like, so that the slider 3 retreats while compressing the first resilient member 11. In the course of this backward movement, (1) the slider 3 is engaged with the slider stopper 81 (2) the vicinity of its rear end portion is received into the drum ring 9 and (3) is engaged with the front-end engaging portion 96 of the drum ring 9.

The normal lead feed described above is performed by the above rear-end knock. In the last stage thereof, the front end of the lead chuck 51 pushes the ejection bar 10, causing it to move forward. As a result, the slits 92 of the drum ring 9 are expanded to enlarge the opening area of the front end portion of the drum ring 9, thus affording a receptacle portion as a slider receiving space. Consequently, the vicinity of the rear end portion of the retreating slider 3 can be received smoothly into the receptacle portion 9a of the drum ring 9.

By such stowing of the slider 3 into the drum ring 9 there is ensured a receptacle portion 9a serving as a locked stowing space for the slider 3. As a result, when the slider 3 is stowed in a locked state, only an extremely small part of the slide pipe 32 projects from the front end of the tip member 2. Thus, an efficient locking and stowing operation for the slider 3 can be effected.

The following is an explanation about the operation for releasing the locked stow of the slider 3 and for the feed of lead.

It is only rear-end knock that is required for the operation just mentioned above. Upon knocking of the rear end, the sleeve 4 and the lead feed mechanism 5 advance together by the distance b. In the course of this forward movement the front end wall portion 95 of the drum ring 9 pushes the inclined surfaces 36a of the engaging recesses 36 of the slider 3. Besides, the first resilient member 11 also urges the slider 3 forward by virtue of its compressive biasing force. Consequently, the engagement between the engaging protuberances 35 of the slider 3 and the slider stopper 81 as well as the engagement between the front-end engaging portion 96 of the drum ring 9 and the engaging recesses of the slider 3 are released (release of the locked stow).

As means for releasing the above engagements there also may be used the front end wall portion 106 of the ejection bar 10.

Next, the ordinary lead feed is performed by rear-end knock.

Thereafter, the slider 3 reverts to the state of FIG. 42(A) under the action of the first resilient member 11, now ready for writing.

In the case where a slide pipe 32a formed by extrusion for example and having a diameter smaller than that of the slider 3 shown in FIG. 36 is fitted in the front end of the slider body 31, the mechanical pencil of the present invention is also applicable as a mechanical pencil for drawing or a like purpose.

In this sixth embodiment, as described above, the unlocking of the slider 3 and the release of the locked stow thereof at the time of front-end knock as well as the release of the engagement between the slider 3 and the slider receiving portion 8 are effected at the front end of the drum ring, so the front-end knock can be done positively as long as the slide pipe is projecting from the tip member.

A seventh embodiment of the present invention will be described below.

In the above sixth embodiment the opening of the drum ring 9 is expanded (opening/closing operation) with forward movement of the ejection bar 10 induced by rear-end knock to ensure a receptacle portion, thereby making it possible to lock and stow the slider 3.

On the other hand, according to the seventh embodiment of the invention, the drum ring 9 is formed not to perform opening/closing operation, thereby dispensing with the receptacle portion for the slider 3. In this seventh embodiment, therefore, it is quite impossible to effect locking and stowing of the slider 3. But the other points, including the lead feed operation, are just the same as in the sixth embodiment.

Since it is not necessary to form a receptacle portion in the drum ring 9 for the slider 3, the drum ring 9 and the ejection bar 10 may be formed as an integral body.

An eighth embodiment of the present invention will now be described. This embodiment concerns an improvement of the lead feed operations of rear-end knock, automatic writing and front-end knock, attained by modifying the elastic modulus of the first resilient member 11. Other constructional points are the same as in the foregoing seventh embodiment.

More specifically, the elastic modulus of the first resilient member 11 is determined so that the biasing force A of the resilient member 11 and the gripping force E of the lead chuck 51 for the lead S are in any of the following relationships:

① Where the retreat distance of the slider 3 into the tip member 2 is not longer than a predetermined distance f (e.g. 0.5 mm):

$A \leqq E$ (Relationship ①)

② Where the said retreat distance is not longer than the predetermined distance f (e.g. 0.5 mm):

$A > E$ (Relationship ②)

Like the seventh embodiment, there exist the relationships $B > A$ (Relationship ③) and $C > D$ among the urging force A of the first resilient member 11, the frictional force B of the friction imparting member 33 for the lead S, the engaging force C between the concave portion 93*a* of the drum ring 9 and the convex portion 104 of the ejection bar 10, and the engaging force D between the slider 3 and the slider stopper 81.

The above three lead feed operations (rear-end knock, automatic writing and front-end knock) are improved. First, the operation of automatic writing as the second means will be explained.

As noted above, automatic writing is usually performed in a projecting state of the lead S by a predetermined distance X from the slide tip 32A, as shown in FIG. 42(A). With writing, the lead S wears gradually until it becomes flush with the tip end of the slide tip 32A, as shown in FIG. 42(B). Even in this state the slider 3 can move back against the biasing force of the first resilient member 11. It can move back up to abutment with the front end wall portion 95 of the drum ring 9, that is, by the retreat distance e shown in FIGS. 1, 42(B) and 42(C). For example, it is here assumed that the writing is stopped when the retreat distance of the slider is $f_1$ ($f_1 < f$) and the tip end of the slide tip 32A is moved out of contact with the paper surface. In this case, since there exist $A < E$ and $B > A$ from the above relationships ① and ③ the slider 3 stops in that position without operating at all. Thereafter, when the slider tip 32A is brought into abutment with the paper surface to restart the writing operation, the slider 3 moves back with wear of the lead S. And if the retreat distance of the slider 3 is $f_2$ ($f_1 + f_2 < f$), there exist the relationships ① and ② like the above case, so the slider 3 stops in that position.

However, when the sum of the retreat distances of the slider 3 becomes larger than the distance f ($f_1 + f_2 2 + \ldots > f$), there exists the relationship ② and the urging force A of the first resilient member 11 becomes larger than the lead gripping force of the lead chuck 51 up to a magnitude which permits the lead S to be pulled out forward from the lead chuck 51. Consequently, the first resilient member 11 causes the slider 3 to advance and at the same time the lead S is allowed to advance together with the slider 3 through a predetermined frictional force provided from the friction imparting member 33. In this way the lead is fed.

The lead feed process will now be explained in detail up to minute operations. When the lead S is pulled in the forward direction by the first resilient member 11, in the head portion of the lead chuck 51 which grips the lead S, the balls 53 come into rolling contact with the tapered inner wall 54*a* of the metallic cylinder 54 and advance. As a result, the head portion of the lead chuck 51 expands outwards so its lead gripping force becomes weaker gradually. During this process there is performed the feed of the lead S. After the end of the lead feed operation, the head portion of the lead chuck 51 moves back a slight distance until it grips the lead S lightly under the biasing force of the second resilient member 56. This retreat distance is slight, a little ahead of the position of the head portion of the lead chuck 51 shown in FIG. 42(B).

By a series of these operations there is performed an automatic lead feed operation, making it possible to effect writing. Continuous writing can be done up to the retreat distance e of the slider 3.

In the first, third, fourth, sixth and seventh embodiments there always existed the relationship ①. In this case, upon interruption of the automatic writing, the first resilient member 11 acts to advance the slider 3 and the lead S continually, so the lead feed operation is executed continually.

After the end of the lead feed operation, as mentioned in detail, the head portion of the lead chuck 51 is located a little ahead of its position shown in FIG. 42(B). Consequently, when backward writing pressure is exerted on the lead S upon re-start of writing, there are performed operations completely reverse to the lead drawing-out operations. More specifically, the lead chuck 51 which has gripped the lead S moves back in rolling contact with the tapered inner wall 54*a* and its inward contraction gives rise to a gradual increase of its lead gripping force until it returns to the position shown in FIG. 42(B), whereby there is effected complete lead gripping. Thus, the lead chuck 51 retreats upon re-start of automatic writing, so some users may feel a sense of incongruity or of discomfort. Besides, this retreat motion of the lead chuck 51 has heretofore occurred always at the time of start of automatic writing.

Also in the case of rear- and front-end knock, a problem based on the same phenomenon as above has heretofore occurred. More particularly, in the lead feed operation, in just the same manner as in automatic writing, the head portion of the lead chuck 51 advances in rolling contact with the tapered inner wall 54*a*, and after the end of the lead feed operation, the lead chuck head is located slightly ahead of its position shown in FIG. 42(A). Therefore, at the time of re-start of writing (the first time) the lead chuck 51 which has gripped the lead S retreats a distance $f_x$ in rolling contact with the tapered inner wall 54*a* while gripping the lead S under the action of writing pressure applied to the lead S. At this time, some users may feel a sense of incongruity or of discomfort (this cannot be prevented even in this eighth embodiment). The retreat distance of the lead chuck 51 is the same ($f_x$) as that of the lead S. And since there exists the relationship ③ as mentioned above, the slider 3 moves back the same distance ($f_x$) through the friction imparting member 33 which is in abutment with the lead S under the frictional force B. Therefore, if the writing is discontinued and the lead S is moved away from the paper surface, the slider 3 advances the distance $f_x$ under the biasing force of the first resilient member 11. As a result, as noted above, the lead chuck 51 is again moved forward and thereafter retreats a slight distance, but is located slightly ahead of its position shown in FIG. 42(A). Therefore, upon re-start of the next (second) writing, the lead chuck 51 again retreats, so some users may feel a sense of incongruity or of discomfort. According to this eighth embodiment, however, such sense of incongruity or of discomfort at the time of re-start of the second and the following writing can be eliminated because the slider 3 will not advance unless the retreat distance of the slider 3 is a predetermined distance or longer.

According to this eighth embodiment, as set forth above, by adjusting the elastic modulus of the first resilient member 11 it is made possible to feed the lead only when the retreat distance of the slider 3 reaches the predetermined distance or longer, and the occurrence of retreat motion of the lead chuck 51 is suppressed to a minimum degree to minimize the sense of incongruity or of discomfort at the time of start of writing. This is particularly effective in writing Japanese characters because the retreat distance of the slider 3 is in many cases below the distance f.

Although in this eighth embodiment the predetermined distance f at the start of lead feed is set at 0.5 mm, this constitutes no limitation if only it is within the distance b or e. Further, although the number of times of interruption of writing in automatic writing was set at twice or more, it may be even once.

A ninth embodiment of the invention will now be explained. This embodiment relates to an improvement of the lead chuck. The greater part of its construction is the same as the preceding embodiments.

In this embodiment, as shown in FIGS. 43 and 44 to 47, the lead chuck 51 is formed as a bisplit chuck along the axis of the lead insertion hole 57 and it comprises a pair of chuck members 51*a* and 51*b* which are hemispheric in section. This bisplit lead chuck has ball holding portions 52 recessed in the outer peripheral portions of the chuck members 51*a* and 51*b*, retaining stepped portions 55 projecting from the said outer peripheral portions, spring retaining projections 55*a* projecting forward in predetermined positions from the front sides of the retaining stepped portions 55, stopper abutting projections 55*b* projecting backward in predetermined positions from the rear sides of the retaining stepped portions 55, rear cylindrical tapered portions 58 extending backward from the rear ends of the retaining stepped portions 55 and smaller in diameter on the rear end side, the lead insertion hole 57 extending through the axis of the lead chuck, engaging recesses 59 and engaging projections 510.

Figure 43A:
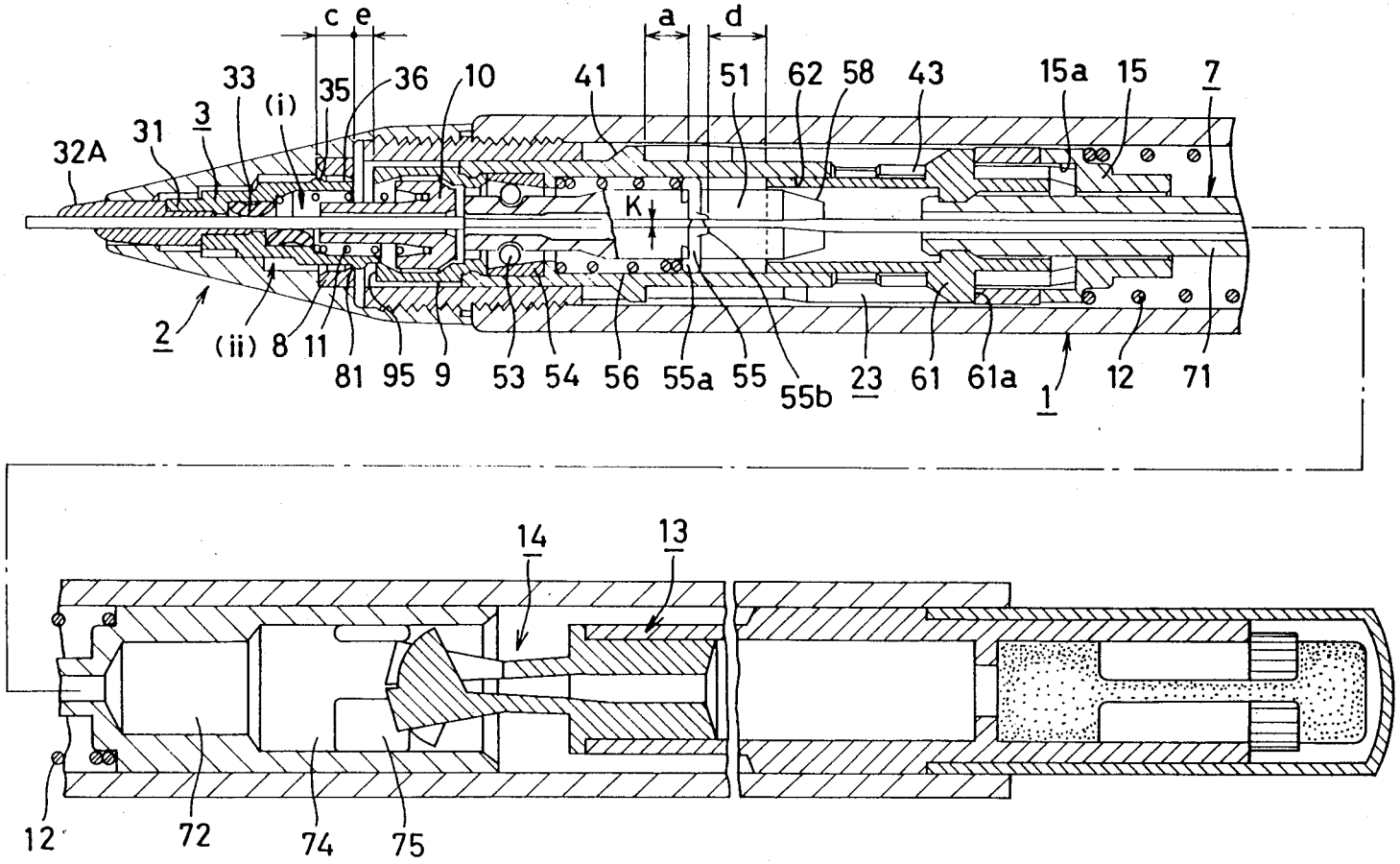
FIG. 43(A) is a longitudinal sectional view of a mechanical pencil according to a ninth embodiment of the invention.
Figure 43B:
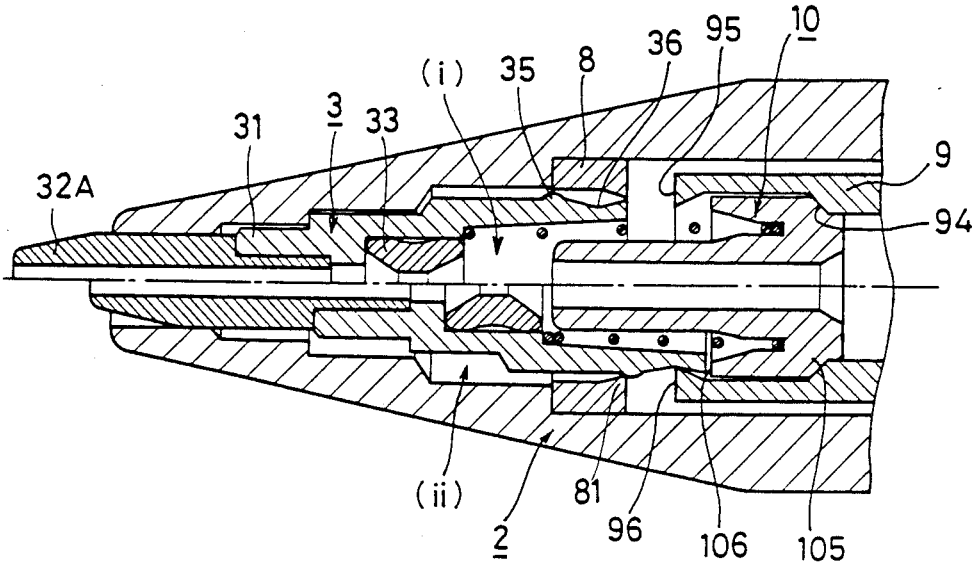
FIG. 43(B) is a longitudinal sectional view of a principal portion thereof.
Figure 47:
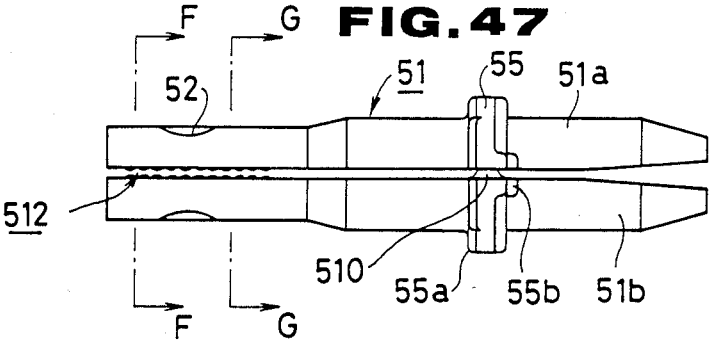
FIG. 47 is a side view of a lead chuck.

The engaging projections 510 are formed longer by a predetermined length than the depth of the engaging recesses 59 to ensure a gap K between the lead chuck members 51*a* and 51*b* as shown in FIGS. 43(A) and 47. The gap K functions as a fulcrum of lever motion of the chuck members 51*a* and 51*b* in opening and closing directions and also functions as a spacer to effect a smooth lever motion.

Figure 48:
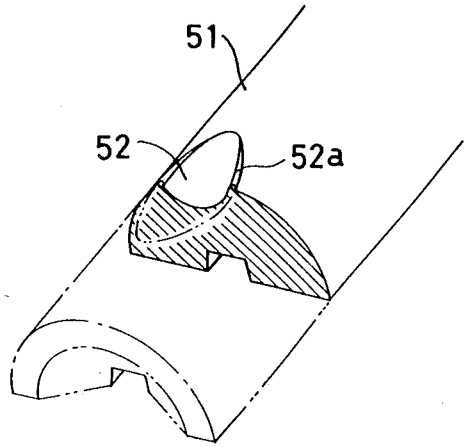
FIG. 48 is an explanatory perspective view of a ball holding portion.
Figure 44:
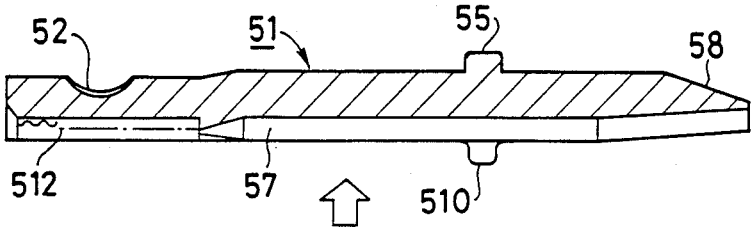
FIG. 44 is a longitudinal sectional view of a lead chuck member.
Figure 45:
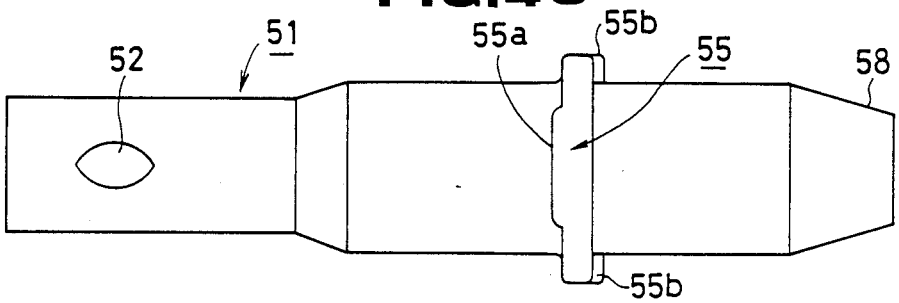
FIG. 45 is a plan view thereof.
Figure 46:
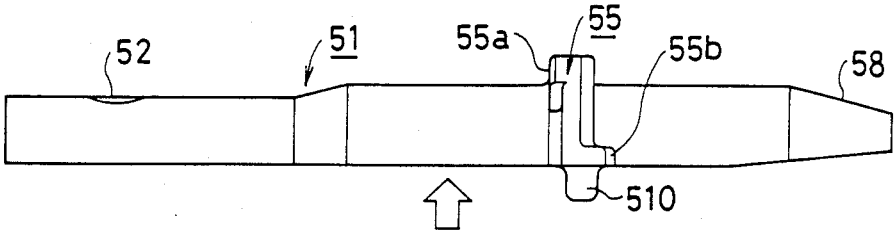
FIG. 46 is a side view thereof.

The ball holding portions 52 each have a bank-like projecting portion 52*a* along the peripheral edge thereof as shown in FIG. 48 so that the ball 53 received therein may not easily escape outwardly sideways.

The spring retaining projections 55*a*, which are for retaining the rear end of the second resilient member 56, are projecting from the retaining stepped portions 55 in back positions of the chuck members 51*a* and 51*b*. On the other hand, the stopper abutting projections 55*b* function to abut the front end of the advancing stopper 6 to create a lead chuck opening force. In this embodiment, a pair of such stopper abutting projections 55*b* are projecting from the retaining stepped portions 55 in both side positions of each of the chuck members 51*a* and 51*b*.

Figure 43C:
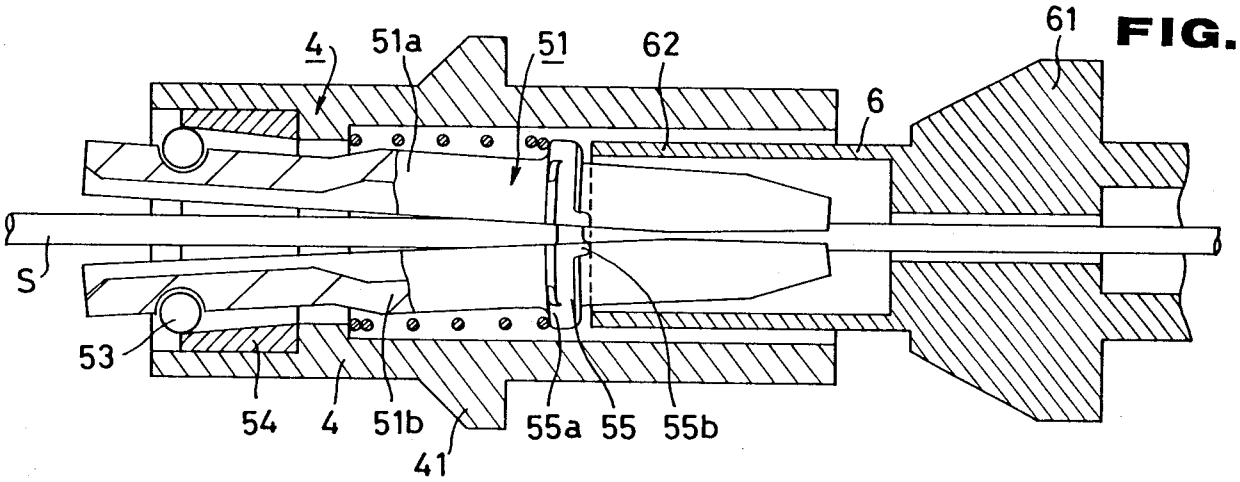
FIG. 43(C) is a longitudinal sectional view of a principal portion of the mechanical pencil in an opened state of a lead chuck.

In this embodiment, the stopper abutting stepped portions 55*b* and the spring retaining projections 55*a* are provided in positions spaced about 90° from the axis of the lead insertion hole 57. In such a positional relation, an opening lever motion of the lead chuck 51 is performed smoothly and positively, as shown in FIG. 43(C), using the retaining recesses 59 and the engaging projections 510 as a fulcrum, by the stopper abutting projections 55*b* which receive a forward urging force from the advancing stopper 6 at the time of rear-end knock and also by the spring retaining projections 55*a* which receive an opposite external force, i.e., a backward urging force, from the therebycompressed second resilient member 56.

Thus, the lever opening motion of the lead chuck 51 can be effected without utilizing the taper means at the rear ends of the lead chuck members 51*a* and 51*b*. Besides, there is no fear of deviation at the heads of the lead chuck members 51*a* and 51*b*.

The distance between the stopper abutting projections 55*b* and the spring retaining projections 55*a* and their positions are not restricted to those in this embodiment. Any such distance and positions may be adopted if only there can be developed a force which induces the opening lever motion of the lead chuck 5.

In this embodiment, moreover, the inner surfaces of both sides of a lead holding hole 512 serve as lead supporting portions 513. As will be described later, the lead supporting portions 513 are in four positions in the case of a four-point support type tooth portion 511*a* shown in FIG. 51. On the other hand, in the case of a six-point support type tooth portion 511*b* shown in FIG. 50, the lead support portions are in four positions initially, but as the lead S becomes finer, bottom portions 512*a* of the lead holding hole 512 also serve as lead supporting portions, that is, the lead is supported at six points. And as shown in FIGS. 19 and 20, the lead supporting portions 513 are each integrally formed with a plurality of tooth portions 511 at predetermined intervals in the width direction of the lead supporting portion.

Figure 50:
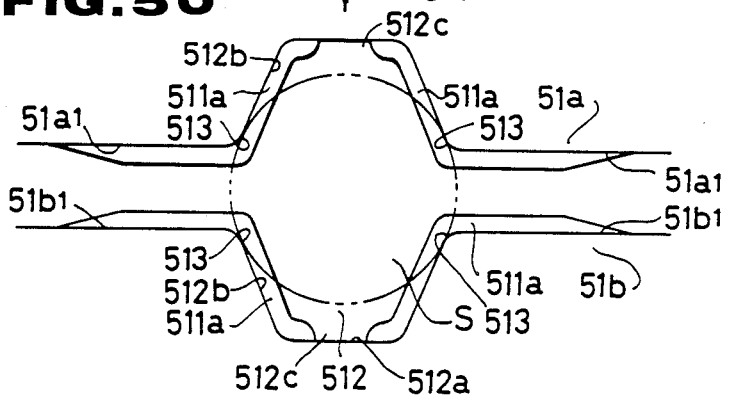
FIG. 50 is a sectional view taken on line G—G of FIG. 17.
Figure 51:
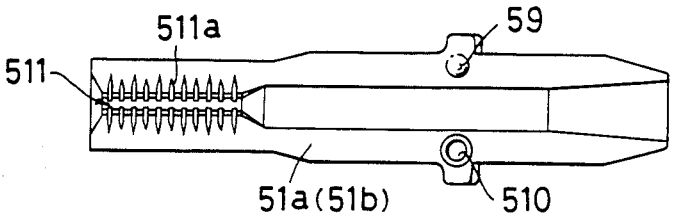

FIG. 51 shows an example of the tooth portion 511 of the chuck members 51*a* and 51*b*. In this example, the tooth portion 511 is formed by only the four-point support type tooth portion 511 shown in FIG. 50.

Figure 49:
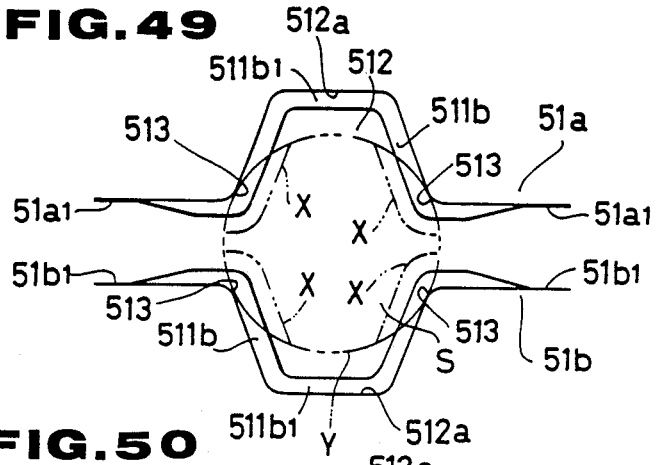
FIG. 49 is a sectional view taken on line F—F of FIG. 47.

As shown in FIGS. 50 and 51, the four-point support type tooth portion 511*a* is formed from a plane portion $51a_1$ or $51b_1$ of the chuck member 51*a* or 51*b* up to a side wall 512*b* of the lead holding hole 512, except the bottom portions 512*a* of the lead holding hole 512. In the portion of each bottom 512*a* having no tooth there is formed a lead waste discharge portion 512*c*. Thus, as shown in FIG. 49, the lead S is four-point supported by the tooth portions 511*a* in the positions of the lead supporting portions 513 which are formed at four points as shown in FIG. 49, so there is no fear of lead slip, etc.

Figure 52:
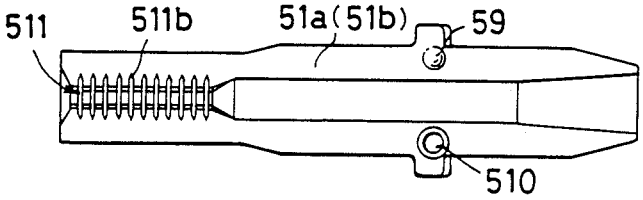

FIG. 52 shows another example of the tooth portion 511. In this example, the tooth portion 55 is formed by only the six-point support type tooth portion 511*b* shown in FIG. 49.

As shown in FIGS. 49 and 52, the six-point support type tooth portion 511*b* is different from the four-point support type tooth portion 511*a* in that the lead waste discharge portion 512*c* is not present and so tooth portion is formed continuously from the plane portion $51a_1$ or $51b_1$ up to the lead holding hole 512.

In the case of the six-point support type tooth portion 511*b*, the lead S is initially gripped in the four-point support positions of the lead supporting portions 513. However, under the influence of writing pressure over a subsequent long time of use, the lead S in the gripping portion becomes finer as indicated by dotted lines (X) in FIG. 49. As a result, the portions of the lead S indicated at (Y) are newly gripped by bottom portions $511b_1$ of the six-point support type tooth portions and thus supported at six points. This six-point support for the lead S further reduces the possibility of lead slip, etc. as compared with the first example.

Figure 53:
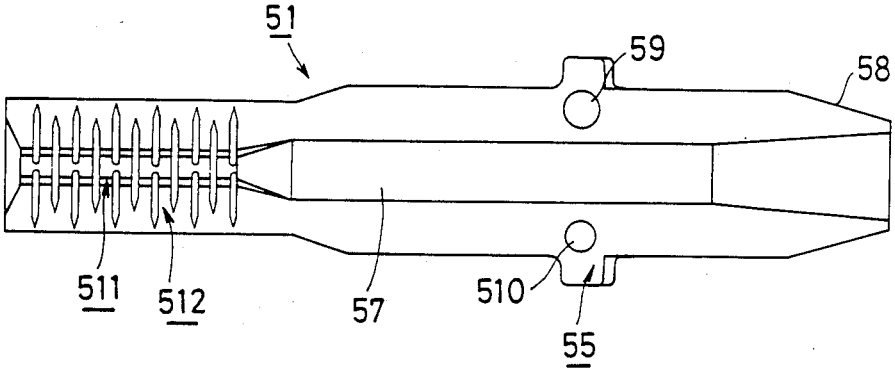
FIGS. 51–53 are bottom views showing examples of lead chuck members.

FIG. 53 shows a further example of the tooth portion 511. In this example, as shown in the same figure, the tooth portion 511 comprises the four-point support type tooth portion 511*a* and the six-point support type tooth portion 511*b*, arranged in positions adjacent to each other alternately.

More specifically, like the other examples described above, the lead S is initially four-point supported by the four-point support type tooth portions 511*a* and the six-point support type tooth portions 511*b*. Thereafter, as the lead S becomes finer over a long period of use as mentioned above, it is supported at six points by the six-point support type tooth portions 511*b*. In this case, the lead S is four-point supported by the four-point support type tooth portions 511*a* and six-point supported by the six-point support type tooth portions 511*b*, and this supported state is repeated alternately in plural number of times.

Thus, the lead S is gripped securely even under changes of its diameter by the two kinds of tooth portions 511*a* and 511*b*, so there is no fear of lead slip, etc.

On the front end side of the stopper 6 there extends a cylindrical front-end portion 62 axially forwardly as shown in FIGS. 43(A) and (C). At the time of rear-end knock, the front end of the cylindrical front-end portion 62 comes into pressure abutment with the stopper abutting projections 55*b* to open the lead chuck 51 in cooperation with the spring retaining projections 55*a* which are urged backward by the second resilient member 56. As shown in FIG. 43(C), moreover, at the time of rear-end knock the cylindrical front-end portion 62 pushes the stopper abutting projections 55*b* while enclosing therein the rear end of the lead chuck 51, whereby the rear end portion of the lead chuck 51 is held in a constant position to prevent the occurrence of deviation at the front end of the lead chuck 51.

The urging force A of the first resilient member 11, the frictional force B of the friction imparting member 33 to the lead S, and the gripping force C of the lead chuck 51 for the lead S, are in the following relations.

(1) $B>A$ If this relation is not satisfied at the time of front-end knock as will be described later, there will occur lead slip between the friction imparting member 33 and the lead S.

(2) $A>C$ This is because it is necessary to pull out the lead S forward from the lead chuck 51 with advance of the slider 3 at the time of later-described front-end knock and so-called automatic writing.

Among the foregoing distances a, c and d there is the relation of $d>a>c$.

The assembling operation for the mechanical pencil of this ninth embodiment is the same as in the previous embodiments, so will not be explained.

The lead feed operation of this embodiment will be described below. Like the previous embodiments, there are three types of operations.

(1) First, in the normal rear-end knock operation (first means), when the sleeve 4, etc. advance by the distance b, the front end of the stopper 6 is retained by abutment with the stopper abutting projections 55*b* of the lead chuck 51 and pushes the lead chuck 51 forward against the urging force of the second resilient member 56 retained by the spring retaining projections 55*a*. In the course of this forward movement, opposite urging forces are exerted on the stopper abutting projections 55*b* and the spring retaining projections 55*a*, respectively, which are formed in predetermined spaced positions as previously noted, so that the lead chuck 51 performs an opening lever motion, using the engaging recess 59 and the engaging projection as a fulcrum, as shown in FIG. 43(C), to release the gripping for the lead S. By repeating these operations there is performed the normal feed of lead.

Thus, the lead chuck 51 is opened by exerting two opposite interactive forces on the retaining stepped portions 55 projecting from the outer peripheral portion of the lead chuck 51. So there is no fear of deviation at the front end portion of the lead chuck 51 which can occur when the lead chuck 51 is opened by picking the rear end of the chuck as in the prior art.

(2) As the second means, the lead feed operation can be performed automatically by the interruption of writing. This operation is the same as in the previous embodiments.

(3) As the third means, two types of front-end knock operations can be performed in the same manner as in the fifth embodiment described above.

Further, the locking and stowing operation for the slider 3 and the release operation in this embodiment are the same as in the fifth embodiment, so will not be explained here.

According to this ninth embodiment, as set forth above, the spring retaining projections and the stopper abutting projections, which undergo opposite external forces at the time of rear-end knock, are formed on the retaining stepped portion in spaced relation by a predetermined distance and an opening lever motion is created by utilizing opposite interactive forces to open the lead chuck. Consequently, there is no fear of deviation, etc. at the front end portion of the lead chuck, so it is possible to effect the lead releasing operation always in a stable state and the slip and breakage of lead caused by deviation at the front end of the lead chuck can be decreased remarkably.

What is claimed is:

1. A mechanical pencil including:
a tip member fitted in the front end of a shell;
a sleeve disposed slidably in the interior of said tip member;
a lead feed mechanism which is mounted in the interior of said sleeve and which permits a forward movement of a lead but inhibits a backward movement of the lead;
an ejection bar mounted on the front end side of said sleeve, with the lead extending through the ejection bar;
a slider disposed slidably within said tip member and having a locking engaging portion capable of engaging said tip member disengageably, said slider imparting a predetermined frictional force to the lead; and
a resilient member disposed between said slider and said ejection bar, said resilient member having an urging force stronger than a lead gripping force of said lead feed mechanism, wherein a drum ring is provided on the front end side of said sleeve, and said ejection bar is disposed slidably within said drum ring.

2. A mechanical pencil according to claim 1, wherein said drum ring fulfills a guide function of retaining said ejection bar in a predetermined position and causing it to slide in a predetermined range.

3. A mechanical pencil according to claim 2, wherein said ejection bar pushes said slider in a locked state to unlock the slider when the ejection bar is retained in an advanced position within said drum ring, and releases a locked and stowed state of the slider when the ejection bar moves forward within the drum ring.

4. A mechanical pencil according to claim 1, wherein said drum ring ensures a receptacle portion for said slider with backward movement of said ejection bar.

5. A mechanical pencil including:
a tip member fitted in the front end of a shell;
a sleeve disposed slidably in the interior of said tip member;
a lead feed mechanism which is mounted in the interior of said sleeve and which permits a forward movement of a lead but inhibits a backward movement of the lead;
an unlocking drum ring mounted on the front end side of said sleeve;
an ejection bar disposed within said drum ring, with the lead extending through the ejection bar;
a slider disposed slidably within said tip member and having a locking engaging portion capable of engaging said tip member disengageably, said slider imparting a predetermined frictional force to the lead; and
a resilient member disposed between said slider and said ejection bar, said resilient member having an urging force stronger than a lead gripping force of said lead feed mechanism, wherein said drum ring incorporates said ejection bar slidably therein and performs an opening and closing operation with slide motion of the ejection bar to thereby ensure a receptacle portion for said slider.

6. A mechanical pencil according to claim 1 or claim 5, further including a stopper which is slidably engaged in sliding slots formed in said tip member and said sleeve, respectively.

7. A mechanical pencil according to claim 6, wherein said sleeve has a projection for engagement with the sliding slot of said tip member.

8. A mechanical pencil according to claim 1 or claim 5, wherein said tip member is axially formed with a slit which permits radial elastic deformation of the tip member.

9. A mechanical pencil according to claim 1 or claim 5, wherein said slider has a plurality of engaging pieces divided by axially-formed slits.

10. A mechanical pencil including:
a tip member fitted in the front end of a shell;
a sleeve disposed slidably in the interior of said tip member;
a lead feed mechanism which is mounted in the interior of said sleeve and which permits a forward movement of a lead but inhibits a backward movement of the lead;
a stopper slidably engaging said tip member and said sleeve;
a slider disposed slidably within said tip member and having a lock engaging portion capable of engaging said tip member disengageably, said slider imparting a predetermined frictional force to the lead; and
a resilient member having an urging force stronger than a lead gripping force of said lead feed mechanism, and urging said slider forwardly, wherein said stopper is slidable along slide grooves formed at said tip member and said sleeve, respectively.

11. A mechanical pencil according to claim 10, wherein there is formed at said sleeve a slit which makes said stopper engage with and slide within said slide grooves.

12. A mechanical pencil according to claim 10, wherein said stopper engages said slide grooves at said sleeve under a given frictional pressure and advances integrally with said sleeve when a forwardly directed force is applied thereto so as to advance separately when said sleeve stops.

13. A mechanical pencil including:
a tip member fitted in the front end of a shell;
a sleeve disposed slidably in the interior of said tip member and having an expandable rear end;
a lead feed mechanism which is mounted in the interior of said sleeve and which permits a forward movement of a lead but inhibits a backward movement of the lead;
a resilient receiving means which contacts the rear end of said sleeve for preventing said rear end from expanding;
a slider disposed slidably within said tip member and having a locking engaging portion capable of engaging said tip member disengageably, said slider imparting a predetermined frictional force to the lead; and
a resilient member disposed between said slider and said ejection bar, said resilient member having an urging force stronger than a lead gripping force of said lead feed mechanism.

14. A mechanical pencil according to claim 13, further comprising means for resiliently biasing said resilient receiving means forwardly.

* * * * *